US006110043A

United States Patent [19]

Olsen

[11] Patent Number: 6,110,043

[45] Date of Patent: Aug. 29, 2000

[54] CONTROLLER-BASED PROGRESSIVE JACKPOT LINKED GAMING SYSTEM

[75] Inventor: Eric Burton Olsen, Henderson, Nev.

[73] Assignee: Mikohn Gaming Corporation, Las Vegas, Nev.

[21] Appl. No.: 08/957,076

[22] Filed: Oct. 24, 1997

[51] Int. Cl.[7] ..... A63F 9/24

[52] U.S. Cl. ..... 463/27

[58] Field of Search ..... 463/25, 26, 27, 463/28, 42, 31, 16, 17, 19, 22

[56] References Cited

U.S. PATENT DOCUMENTS

| | | | |
|---|---|---|---|
| 5,564,700 | 10/1996 | Celona . | |
| 5,611,730 | 3/1997 | Weiss . | |
| 5,941,773 | 8/1999 | Harlick | 463/26 |
| 6,015,347 | 1/2000 | Maahs et al. | 463/27 |

FOREIGN PATENT DOCUMENTS

| | | |
|---|---|---|
| 36472/95 | 5/1996 | Australia . |
| 2 151 054 | 7/1985 | United Kingdom . |

OTHER PUBLICATIONS

John Acres, Gaming Innovations Concept III, circa Mar. 1993, 18 pages.

Form SB–2 Registration Statement Under the Securities Act of 1933, Sep 20, 1993, 51 pages—Acres Gaming.

*Primary Examiner*—Valencia Martin-Wallace
*Assistant Examiner*—John Paradiso
*Attorney, Agent, or Firm*—Dorr, Carson, Sloan & Birney, P.C.

[57] ABSTRACT

A method of operating of controller-based progressive gaming system having a plurality of gaming machines wherein each gaming machine generates unit bet information indicative of a number of unit bets supplied to a machine for playing a game. The method comprises the steps of randomly selecting a bonus mode activation value between a high and low limit, providing a current value, providing a base value, incrementing the current value when the gaming machines are played so that the current value is incremented by a fixed amount of each unit bet received by each gaming machine. A bonus mode time period is entered when the incremented current value is equal to or exceeds the bonus value. Eligible machines are locked-in and random bonus jackpots are made during the bonus time period. Each bonus award decrements the current value by the amount of each award and the bonus mode time period is ended when the current value is less than or equal to the base value.

46 Claims, 11 Drawing Sheets

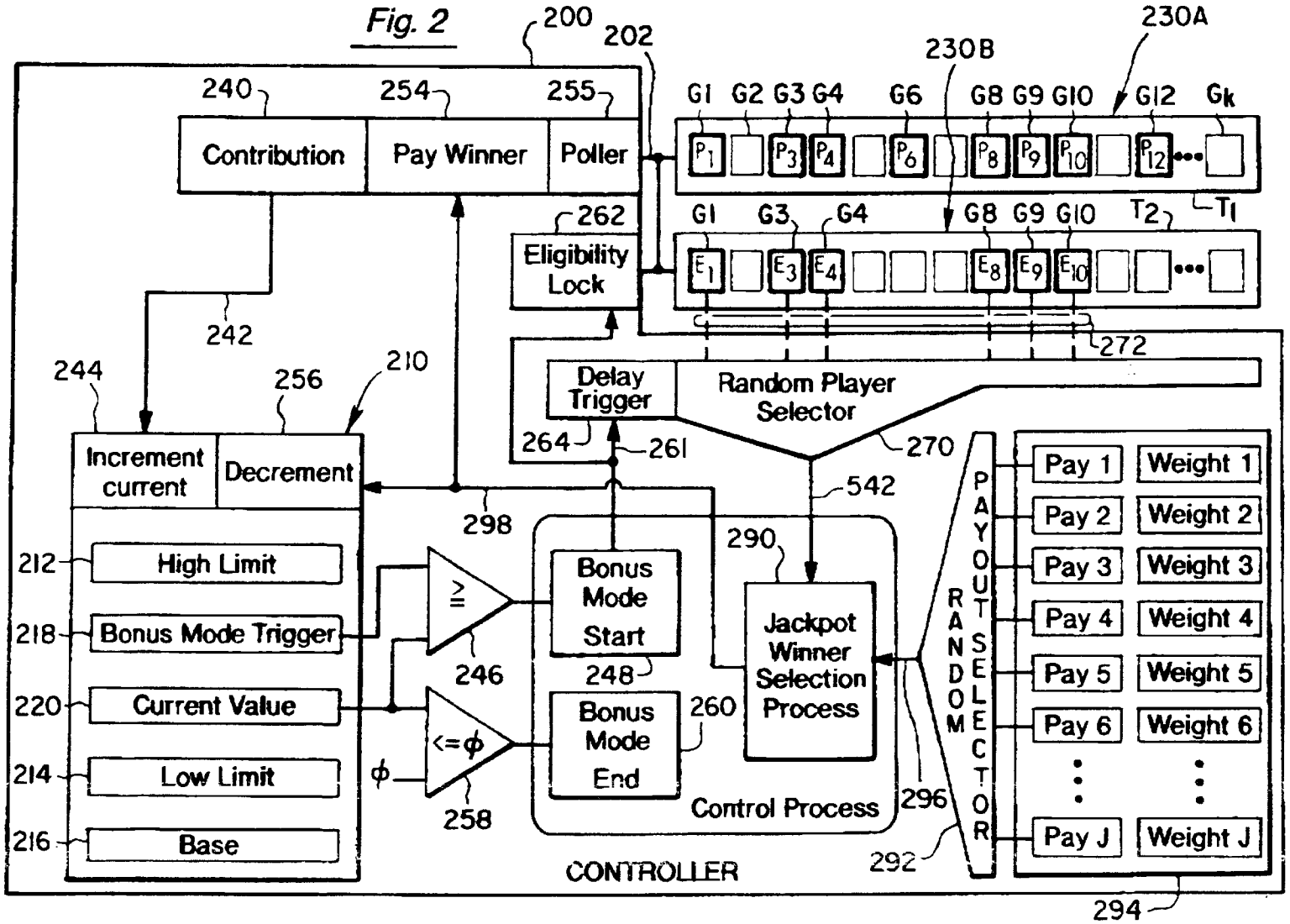
Fig. 2
200
202
230A
230B
G1 G2 G3 G4 G6 G8 G9 G10 G12 Gk
T1 T2
P1 P3 P4 P6 P8 P9 P10 P12
E1 E3 E4 E8 E9 E10
Poller
Pay Winner
Contribution
Eligibility Lock
Random Player Selector
Delay Trigger
Jackpot Winner Selection Process
Bonus Mode Start
Bonus Mode End
Control Process
CONTROLLER
Pay 1 Pay 2 Pay 3 Pay 4 Pay 5 Pay 6 Pay J
Weight 1 Weight 2 Weight 3 Weight 4 Weight 5 Weight 6 Weight J
PAYOUT TRANSDUCER
Decrement
Increment current
High Limit
Bonus Mode Trigger
Current Value
Low Limit
Base
>=
<=ϕ
ϕ
210 212 214 216 218 220 240 242 244 246 254 255 256 258 260 261 262 264 270 272 290 292 294 296 298 542

Fig. 7
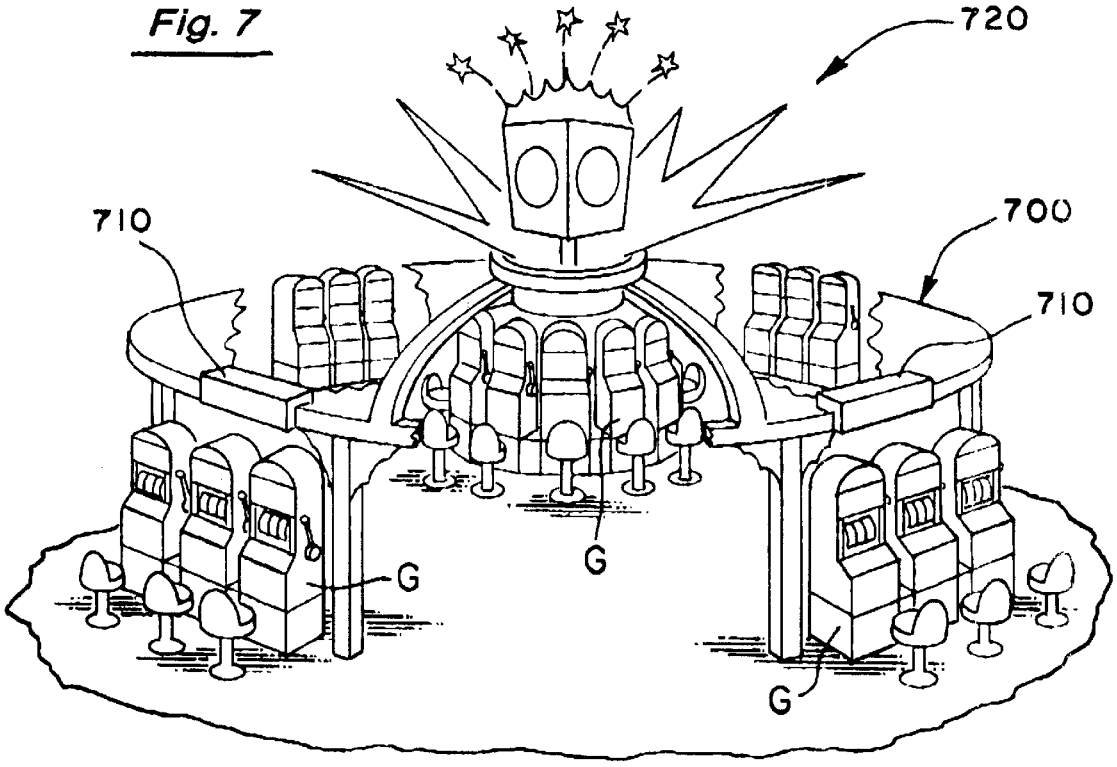
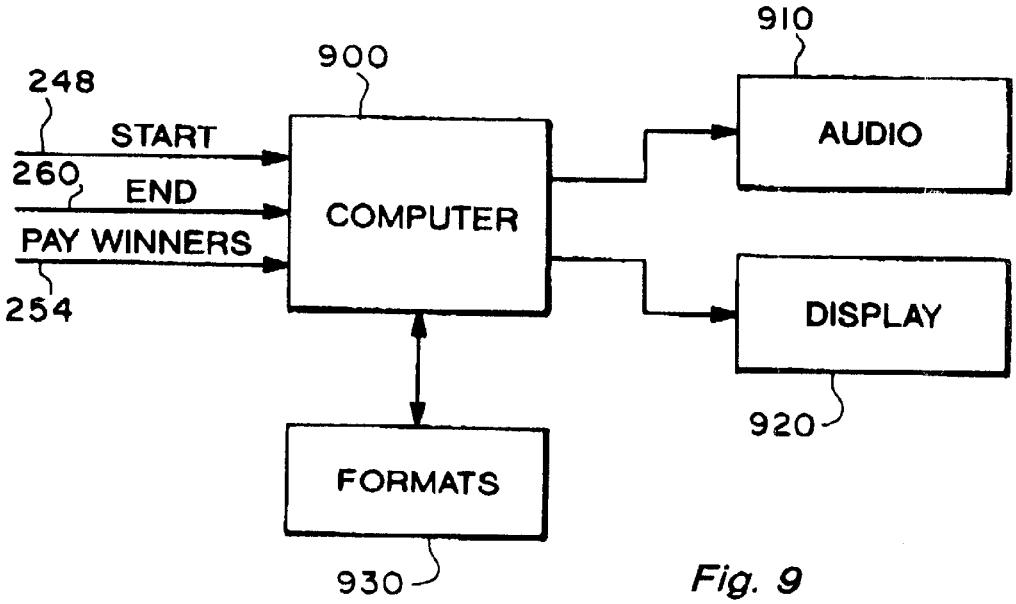
Fig. 9

Reset
1000
Attract Mode ?
1010
Yes
No
Activate Attract Mode
1020
Eligible ?
1030
Yes
No
Update Eligibility
1040
Bonus Mode Start ?
1070
Yes
No
Start Bonus
1080
Bonus Mode End ?
1090
No
End Bonus
1092
Jackpot Hit ?
1094
Yes
No
Jackpot Celebration
1096

CONTROLLER-BASED PROGRESSIVE JACKPOT LINKED GAMING SYSTEM

BACKGROUND OF THE INVENTION

1. Field of the Invention

This invention relates to gaming machines and, in particular, to controller-based progressive jackpot linked gaming systems.

2. Statement of the Problem

Gaming machines are well known and include a variety of games such as slot, poker, and keno. Gaming machines can also be programmed to play a variety of games. Players insert monetary amounts by inserting coin, token, paper currency, or magnetic card; pushing credit buttons; or other suitable entry to play one or more games on a particular gaming machine. Such monetary amounts are usually translated into a number of units of the lowest unit of currency receivable by the machine, referred to herein as the unit bet. Translation into unit bet is conventionally carried out by representing each unit bet as a single pulse so that the generation of P pulses would correspond to a currency entry equal to P unit bets. Thus, in a gaming machine whose unit bet equals one dollar, the entry of three "dollar unit bets" corresponds to P equals three, resulting in the generation of three pulses within the machine. The monetary value may also be digitized and sent as a digital signal. Such operation is well known in the art.

Upon entry of a monetary amount, the gaming machine examines the generated unit bet pulses and determines therefrom which games and/or awards the player qualifies for based upon an internal game in the machine and on an associated pay table located in the machine. The player is then normally required to take some action to institute playing of the game such as pushing a play button or pulling a lever arm. The player then plays the game according to the rules of the game. The player either wins the game or loses the game. If the player wins the game, the player is given the award established by the gaming machine for the particular game being played. This award varies considerably from type of game played to the type of winning combination in the rules of the game. Typically, the award is a return of monetary amounts equal to or in excess of the monetary amounts entered to play the game. Winning or losing the game completes the gaming cycle. The gaming machine then conditions itself so as to be able to again receive monetary amounts to begin another game cycle and the process repeats. Such individual stand-alone conventional gaming machines are found in numerous casinos throughout the world and are made by a number of different manufacturers.

In order to attract more players to such gaming machines, progressive gaming systems were developed. Progressive gaming systems permit the player to play individual gaming machines as discussed above. To add to the excitement of play, the individual gaming machines are linked together to allow players to compete for an additional common award or "progressive jackpot." The progressive jackpot award can amount to a substantial amount of money. Progressive gaming systems are also found in casinos throughout the world. In some environments, the progressive jackpot award is an expensive vehicle, such as a motorcycle or sports car. In progressive gaming systems, a programmed controller is provided for linking the machines together. The controller receives the unit bets from the linked machines as well as machine identification information from each machine and supplies to the players, either through displays provided on their respective machines and/or a common overhead display, information as to the common progressive jackpot.

In one type of progressive system, the controller controls the progressive game during each progressive game cycle by first establishing a jackpot-win amount in a random manner between maximum and minimum jackpot values. The controller has an internal random number generator for making this random selection. The controller also establishes a base value which is used as an initial amount for a current progressive jackpot amount, which is the progressive jackpot amount reported by the controller to the machine displays and/or the overhead display and display to the players. The current jackpot amount is recalculated or incremented by the controller each time a game is played at each gaming machine. The controller does this by adding to the current progressive jackpot amount an increment value based on the number of unit bets entered at the individual gaming machines in the progressive gaming system multiplied by a fixed progressive increment rate per unit bet. This is a continuous process since players at different machines are inserting monetary amounts to start game play at different times.

To this end, each gaming machine, as above indicated, reports its unit bet information to the controller upon a player playing the gaming machine so that the current progressive jackpot value can be appropriately incremented. The gaming machine is also identified with conventional signaling to the controller with the bet information so that the controller knows which gaming machine resulted in the increment.

After each increment of the current progressive jackpot, the controller compares the new current jackpot value with the jackpot-win value, which it previously randomly established and stored. If the new value is less than a jackpot-win value, the controller merely updates the current jackpot value and communicates the updated value to the displays at the gaming machines and/or the overhead display. The controller then continues to monitor the unit bet information indicative of game play from the gaming machines and to increment the current progressive jackpot value based thereon.

When an increment to the current jackpot value causes the value to reach or become equal to the jackpot-win value, the controller determines that the jackpot has been won by the gaming machine, which resulted in the aforesaid increment. The controller communicates this to the winning gaming machine and the appropriate payment of the jackpot-win amount is made to the player. This suddenly surprises the player as it comes unexpectedly and adds excitement to the game.

After a jackpot has been won, the controller then institutes a new progressive game cycle in which it resets the progressive jackpot by randomly selecting, from values between the maximum and minimum jackpot values, a new jackpot-win value. The controller then also resets the current jackpot value to the base value and begins incrementing this value based on the fixed progressive increment. As before, this incrementing continues until the current jackpot value reaches the newly selected progressive jackpot-win value and the progressive jackpot is won again. The controller then repeats the progressive game cycle based on continued game play, as described above. The above type of linked random jackpot controller-based systems have been sold by the assignee of the present invention under the trademark MYSTERY JACKPOT and, for example, is discussed in U.S. Pat. No. 5,280,909. The '909 patent specifically teaches that the jackpot payout need not be a fixed jackpot-win value and that the award could be issued based upon conditions at the machine and only paid when the next winning combination occurs at the machine. For example, the payout criteria might be to payout a jackpot equal to the award for the next winning combination established at the machine.

A need exists to improve upon the above progressive gaming system to attract players, to retain players at the gaming machine by extending play, to provide greater unpredictability and to add more excitement in playing the progressive gaming system.

A need exists to provide players with a feeling of group participation as they play a progressive game wherein players are competing against each other in a race for prizes.

A need exists to provide different base values for the start of each game that are random so as to add more unpredictability to the game.

A need further exists to randomly select players for awarding the jackpot so as to attract and retain more players at the game.

A need finally exists to randomly select awards from a weighted payout table so as to add more randomness to the game.

SUMMARY OF THE INVENTION

1. Solution to the Problem

The present invention solves the above problem by providing improvements to the randomness of the controller-based linked random jackpot system. The improvement is designed to attract more players, to retain players at the gaming machines during extended play, to provide greater unpredictability and to add more excitement in playing the progressive gaming system. The game of the present invention incorporates group participation. When a bonus mode time period is entered eligible players are awarded jackpots of random value in rapid succession creating a frenzied atmosphere for the eligible players. The improved progressive system of the present invention adds more randomness in playing the game, provides jackpot awards of random value in a bonus mode time period of random length, and randomly selects winner machines during the bonus mode time period 2. Summary A system and method of operating of a controller-based linked random jackpot system having a plurality of gaming machines wherein each gaming machine generates unit bet information indicative of a number of unit bets supplied to a gaming machine for playing a game. The method includes the steps of randomly selecting a bonus mode value between a high and low limit, providing a current value, and incrementing the current value when the gaming machines are played so that the current value is incremented by a fixed amount of each unit bet received by each gaming machine. The system enters a bonus mode time period when the incremented current value is equal to or exceeds the bonus mode activation value. The jackpot bonus pool is set equal to the bonus mode activation value. The system determines which gaming machines are eligible by locking in all gaming machines that have received a monetary amount within a predetermined time frame after play has started in response to entering the bonus mode time period. The system randomly awards bonus jackpots to randomly chosen eligible gaming machines during the bonus time period. The system randomly selects which eligible gaming machines are to receive bonus jackpots and randomly selects the bonus jackpots from a weighted payout table. Each bonus jackpot decrements the pool by the amount of each jackpot and the bonus mode time period is ended when the jackpot bonus pool is less than or equal to zero.

BRIEF DESCRIPTION OF THE DRAWINGS

FIG. 2 is the functional block diagram of the linked random jackpot gaming system of the present invention incorporating bonus mode time period jackpots.

FIG. 7 sets forth a second operating environment embodiment incorporating the system of the present invention implemented in a circular frame with audio, visual and graphics displays.

FIG. 9 sets forth a block diagram of the system of the present invention interacting with an audiovisual display system.

DETAILED DESCRIPTION OF THE INVENTION

1. Prior Art

Figure 1:
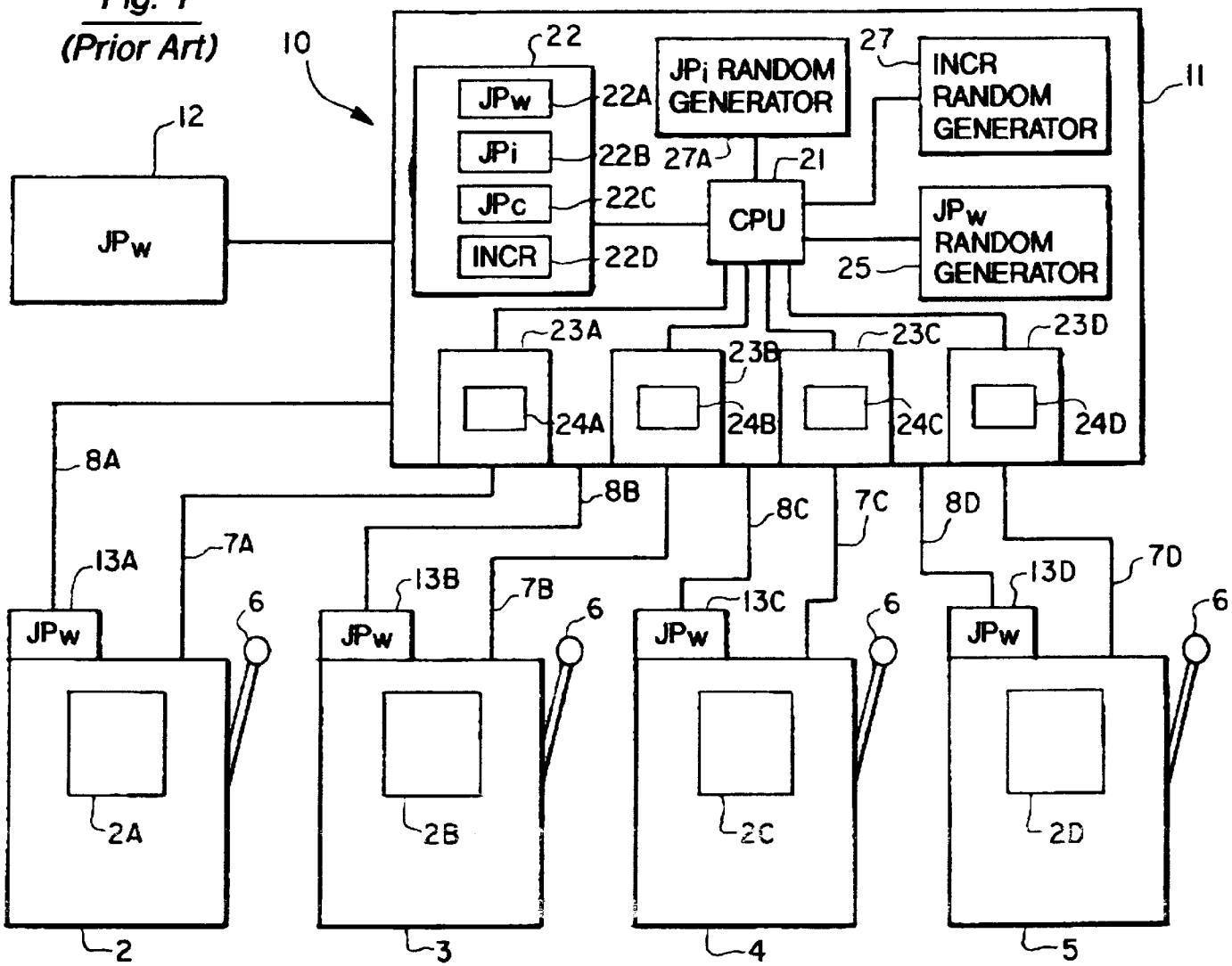
Fig. 1 (Prior Art)
FIG. 1 is the Prior Art system block diagram from U.S. Pat. No. 5,280,909.

FIG. 1 sets forth a prior art linked random jackpot system from U.S. Pat. No. 5,280,909. The following is an adaptation of the teachings of the '909 patent . However, it is to be understood that any conventional progressive controller could be adapted to the teachings of the present invention and the preferred embodiment of the present invention uses the SUPER or SUPREME controller available from Mikohn Gaming Corporation, 1045 Palms Airport Drive, Las Vegas, Nev. 89119.

The present invention is not limited to the type of controller, or type of gaming machine or the type of communication (media), as the invention is functionally described later. Any type of gaming machine that receives bets in order to play a game at the machine is contemplated to be used under the teachings of the present invention including devices such as slots, video games of all types, live card games with tables interfacing with electronic equipment, internet and/or networked games, etc.

FIG. 1 shows a plurality of conventional gaming machines 2, 3, 4, and 5, which are adapted for use with a conventional progressive gaming system. Each of the machines is a reel type slot gaming machine having reels 2A, 2B, 2C and 2D, respectively, and the same unit bet, such as $0.25. It is to be expressly understood that the unit bets and/or monetary value can be in any form to activate a gaming machine such as, but not limited to: coins in, credit play, paper money in, cards in, tickets in, values downloaded over a network, etc.

In normal use, a number of unit bets are inserted into a gaming machine and, depending upon the number inserted, the player plays for one or more awards or payouts. These awards or payouts depend upon certain winning combinations being displayed by the respective reels of the gaming machine when the game is played and as determined by an internal pay table.

Each unit bet applied to a gaming machine is converted into an electrical pulse or signal to signify that the unit bet has been applied. The gaming machine then knows by the number of pulses generated which awards or payouts the player is playing for. In many conventional controllers the unit bet information is serially digitized.

Initiation of a game cycle on each gaming machine begins when the player pulls the machine handle 6, causing the respective reels to spin and stop at certain combinations which are displayed to the player. How a game cycle on a gaming machine is initiated is immaterial to the teachings of the present invention. Game cycles can be started by pulling a handle, pushing a button, playing a hand, automatic start, etc. If the combinations developed are those for which an award or payout is to be made, the gaming machine provides the payout, which is usually some multiple of the unit bet.

In order to stimulate play on the gaming machines 2–5, a progressive jackpot system 10 is utilized. The prior art progressive system of FIG. 1 enables the players playing on gaming machines 2–5 to compete for an additional jackpot which is reached as a result of game play at the machines, but which is not won based upon winning at the machines. As shown, the system 10 includes a programmed controller 11 which links gaming machines 2–5 and which establishes and controls the progressive jackpot. The prior art system also includes a common display 12, as well as individual displays or meters 13A–13D, located at the gaming machines, all of which display the same jackpot information received from the controller 11 on lines 8A–8D, respectively.

In the '909 patent, the controller 11 includes a central processing unit (CPU) 21, a memory 22 and communication interfaces 23A–23D, which include storage buffers, or registers 24A–24D. The latter interfaces receive and transmit information from and to lines 7A–7D, which are connected to the gaming machines 2–5. The lines 7A–7D and corresponding interfaces 23A–23D serve as identification to the controller 11 that the information being received is attributable to a particular gaming machine.

The controller 11 also includes a jackpot-win value generator 25, which establishes the jackpot-win value, $JP_w$, for the jackpot of the progressive system. In the '909 patent, the generator 25 is a random number generator, which randomly establishes in standard fashion the value $JP_w$, from between maximum and minimum jackpot values JPmax and JPmin.

The jackpot-win value $JP_w$ is stored in a register 22A of the memory 22 for use by the controller 11 during game play on the machines to establish whether the progressive jackpot has been won. Also stored by the controller 11 in registers 22B, 22C and 22D of the memory 22 is a base or initial jackpot value, $JP_i$, a current jackpot value, $JP_c$ and an increment per unit bet value, INCR, all of which are also used in determining whether the progressive jackpot has been won. At the start of each progressive game cycle, the value of $JP_c$ is set to $JP_i$.

As fully discussed in the '909 patent, the controller 11 increments $JP_c$ with contributions from each machine 2–5 as monetary values are inserted. When $JP_c > JP_w$, a win exists and the particular gaming machine whose incremental contribution caused the win is identified as the winner and wins the jackpot.

The above discussion closely parallels the prior art controller and the operation of the progressive game discussed in the '909 patent. While the present invention represents an enhancement on the '909 system, it is to be expressly understood that the controller of FIG. 1 is discussed by way of example. As mentioned, any conventionally available progressive controller could be adapted under the teachings that follow.

2. Overview of Present Invention

The present invention improves upon the prior art system of FIG. 1. In FIG. 2, the functional operation of the present invention, which can be implemented in a conventional controller 200, network 202, and gaming machine G configuration, is set forth.

The controller 200 of the present invention provides three areas of randomness that are not found in the '909 patent. First, a more random game start is provided. The bonus mode trigger function 210 of the present invention is similar in operation to the operation of memory 22, CPU 21, and $JP_w$ random generator 25 in the '909 patent. However, in the bonus mode trigger function 210, the initial value of the current value 220 at the start of each new game cycle is indeterminate. This is in contrast to '909 approach wherein $JP_c$ was set equal to a base value. Hence, an additional element of randomness is injected in the system of the present invention since the initial current value 220 is unknown and indeterminate from game to game. Only on system start-up is a base used as in the '909 patent. Second, a number of randomly selected eligible machines are awarded bonus jackpots for an indeterminate length of time. Only eligible machines are entitled to receive bonus jackpots during this bonus award time period and those eligible machines are randomly selected by random player selector process 270. Third, the random award selector process 292 awards bonus jackpots of random value based upon a weighted payout table 294 located in the controller. Each of these elements of randomness will be discussed hereinafter.

3. Random Start

In FIG. 2, a high limit 212, a low limit 214, as well as a base value 216 are provided in function 210. A randomly chosen bonus mode activation value or trigger 218 is also provided. The current value is shown as 220. The high limit 212 and the low limit 214 are set to any suitable value by the operator of the system. The base is preferably set to zero or any suitable amount also by the operator. For each bonus mode game cycle of the present invention, a new bonus mode activation value 218 is randomly chosen which is similar to the teachings of the '909 patent. The current value 220 is then incremented in a fashion described above for the '909 patent when each gaming machine is played. Functions 212, 214, 216, 218, and 220 can be either software based or actual hardware registers. In the preferred embodified, the controller 200 is programmed and these functions exist in associated memory.

In FIG. 2, an island 230 of gaming machines G is provided. In the preferred embodiment, these gaming machines G are referred to as G1, G2, . . . Gk. Any suitable number of gaming machines G could be used under the teachings of the present invention. In the preferred embodiment, the gaming machines are generally arranged in concentric circles where k is typically 40 or any suitable number. As shown in FIG. 2, and by way of example, players P are playing gaming machines G1, G3, G4, G6, G8, G9, G10, and G12. It is to be expressly understood that while this example shows individual players playing individual gaming machines, that it is common for a single player to play more than one gaming machine G. The remaining gaming machines (i.e., G2, G5, G7, G11 and Gk) are not being played by players in this example.

Throughout this description, an ongoing example involving players P1, P3, P4, P6, P8, P9, P10, and P12 will be used with respect to the above configuration of players and gaming machines. The purpose of this example is to illustrate the operation of the present invention. It is not meant to limit the teachings contained herein to the specific configuration shown.

Each gaming machine G has an interface card, not shown, which communicates with the controller 200 over network 202. As illustrated in FIG. 2, contributions are collected, such as is taught by the '909 patent (and is otherwise conventional) by function 240 from each gaming machine G that is being played by a player P. In other words, a fixed increment rate from the monetary value inserted by a player P into a gaming machine G is collected and is used, as is shown by line 242, to increment 244 the current value 220. This increment function 244 causes the current value 220 to increase. Hence, as players P insert monetary value into the gaming machines G, a fixed increment rate is collected 240 from each played machine G and is used to increment 244 the current value 220. It is to be expressly understood that the term "fixed increment rate" could be any suitable "amount" or "percentage" of the unit bet or of the monetary value. Furthermore, the teachings of the present invention are not to be limited to a "fixed" contribution since it is possible that a "variable" increment rate could be used based upon the amount of the monetary value. Finally, it is also possible that players could separately bet in order to participate in the game of the present invention at each gaming machine and that the "increment rate" could be based on such separate side bets.

When the controller 200 determines that the current value 220 equals or exceeds 246 the bonus mode activation trigger 218, the controller 200 starts 248 the "bonus mode time period" of the present invention. The value of the bonus mode trigger 218 is randomly selected by a random number generator, not shown, in the controller 200 to be an integer value between the high 212 and low 214 limits. This prevents anyone, even casino personnel, from having the ability to know exactly when the bonus mode starts 246. The start 248 of the "bonus mode time period" is announced with audio and visual display fanfare as will be explained later.

The contribution 240 collected from the particular gaming machine G causing the current value 220 to increment 244 to equal (or be greater than) 246 guarantees eligibility of that particular gaming machine and causes the bonus mode to start 248.

This is an important feature of the present invention. A single player playing his or her gaming machine upon insertion of monetary value into that machine will have a contribution 240 collected from it which will increment 244 the current value 220 to equal or exceed 246 the bonus mode activation trigger value 218 to start 248 the bonus mode time period. The timing of this is unexpected and comes as a surprise to all eligible players playing gaming machines G when they witness the audio and visual announcement. Hence, the bonus mode time period of the present invention randomly starts in the fashion described above. The value of the jackpot pool is set to equal the bonus mode trigger value 218.

The randomness of this start is even greater than that taught in the '909 patent. The initial value for the current value 220 of each game cycle is not set to a fixed base value 216, but is set to a value indeterminate to any player and to a value which varies from game cycle to game cycle as discussed next. Upon system start-up, the current value is set to the base value 216. The base value may also be a seed value, if desired by the operator, in which case it would be added to the current value. As will be more fully discussed, the jackpots awarded are always fully funded, as game cycles are played, even though for a particular game, the current value 220 may start negative.

Bonus jackpots are made to one or a number of eligible machines during the bonus mode time period. Each bonus jackpot has a value 298 which is paid 254 to a random winning eligible gaming machine. Each jackpot paid 254 causes the current value 220 to decrement 256. When the current value 220 is decremented 256 to be equal to or less than 258 zero from successive bonus jackpots 298 paid 254 to random eligible winning machines, the controller 200 ends 260 the bonus mode time period. It should be understood that a randomly generated turn-off value other than zero could also be used under the teachings of the present invention.

Under the teachings of the present invention, at the start 248 of each bonus mode game cycle, the system randomly chooses a bonus mode activation trigger 218 between the high 212 and low 214 limits according to any of a number of conventional random number generating programs based in controller 200. Whatever the current value 220 was from the prior bonus mode game cycle is used as the starting current value 220 in the current bonus mode game cycle and is continually incremented 244 by collected contributions 240 from gaming machines G in the new gaming cycle. These incremental contributions cause the current value 220 to equal 246 the bonus mode activation trigger value 218 and the controller 200 starts 248 a new bonus mode time period. The jackpot pool is set equal to the random bonus mode trigger value. During this new bonus mode time period, bonus jackpots 298 are again awarded 254 to eligible machines and each award causes the current value 220 to decrement 256 until it equals or is less than 258 zero in which case the new bonus mode time period ends 260.

The start 248 of the bonus mode locks in the jackpot pool for the entire bonus mode. This jackpot pool is equal to the value of the bonus mode trigger 218. In the preferred operation of the '909 patent, this entire value would have been given to the machine G whose contribution caused the trigger 246 to occur. Under the teachings of the present invention, this trigger value provides the value for a jackpot pool from which the jackpots 298 are deducted 256. Any contributions 240 after the start 248 occurs in the preferred embodiment, are not added to the jackpot pool. If such contributions were allowed, then conceivably one eligible machine could play indefinitely from the pool being funded by the other non-eligible players. The additional contributions go to the new current amount.

In the preferred embodiment, the current value 220 at the end 260 of the prior game cycle of the present invention becomes the basis for the current value 220 of the next game cycle. By setting the prior current value to the next current value this provides a degree of randomness and uncertainty since it prevents players from watching a number of game cycles of the present invention in order to predict when to start playing games so as to enhance their likelihood of winning. The current value 220 at the beginning of a game cycle, corresponding to the current value 220 of the prior game cycle, is unknown and different each time. This will be more thoroughly explained later. This process also guarantees that bonus jackpots are fully financed and never cause the system to operate in the red.

4. Locking-In Eligible Gaming Machines

In FIG. 2, the player island 230 is represented functionally as two separate configurations, in time (i.e., times $T_1$ and $T_2$) based upon player eligibility. Island 230A shows the configuration of all players P playing gaming machines G at a first time, $T_1$, just prior to the start 248 of the bonus mode time period and island 230B shows the configuration of only the eligible players E playing gaming machines G at a second time, $T_2$, corresponding to the start 248 of the bonus mode time period. Not all players P playing the conventional game at the gaming machines G become eligible players E. In the example shown in FIG. 2, players P6 and P12 do not become eligible players, at time $T_2$, and their gaming machines G6 and G12 are ineligible. Whether a player is eligible to play the bonus game or not depends on the controller locking in 262 eligible machines G so as to participate in the controller-based bonus mode game of the present invention. It is to be expressly understood that the locked-out (or ineligible) machines G could still be conventionally played. In FIG. 2, the example shows only machines G1, G3, G4, G8, G9, and G10 to be eligible and locked in 262 at time $T_2$.

Figure 3A:
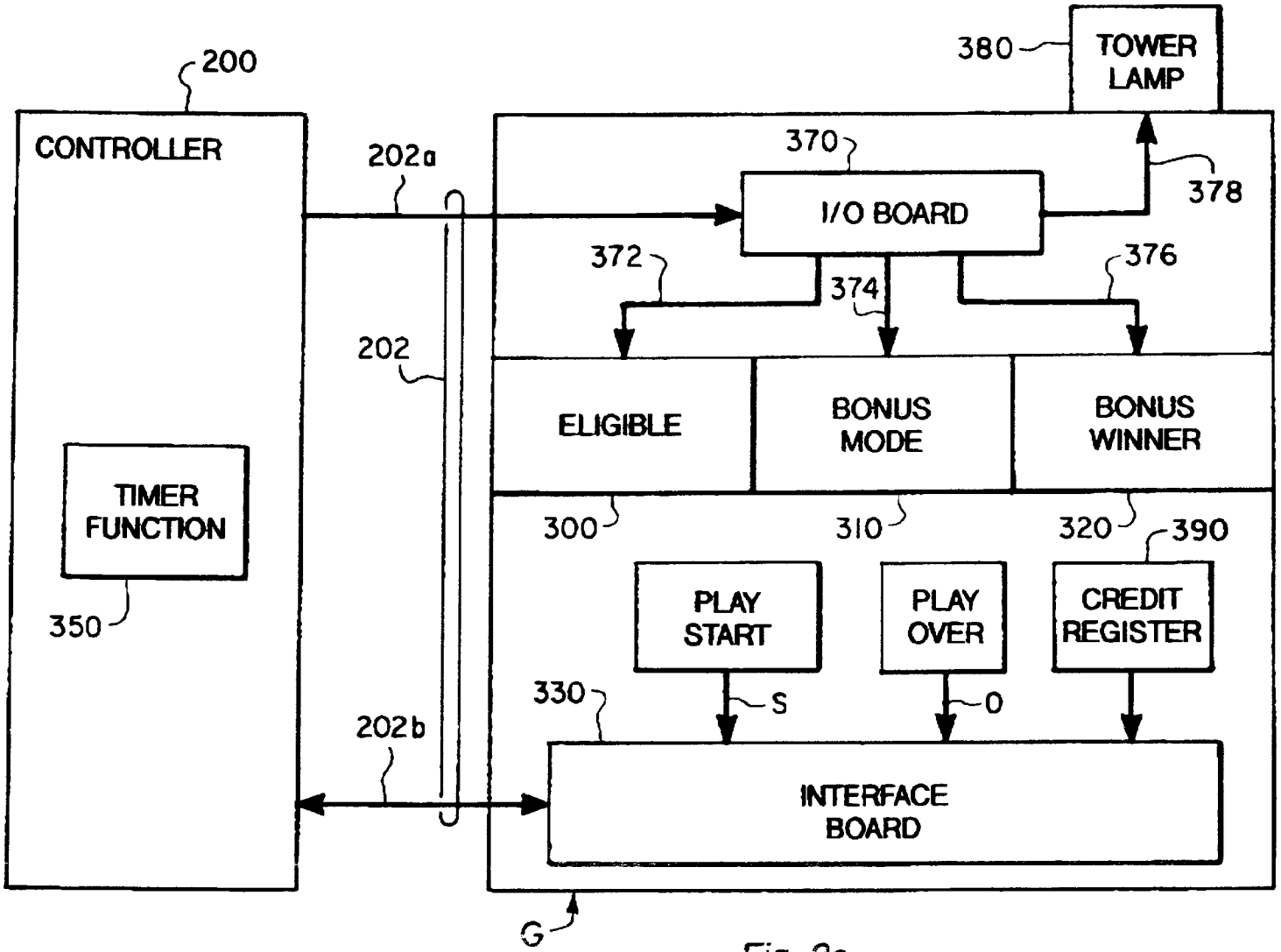
FIGS. 3*a* and 3*b* set forth the interface with a gaming machine.

In FIG. 3*a*, a conventional gaming machine G is modified to have three indicators 300, 310 and 320. Indicator 300 conveys an eligibility message to a player, indicator 310 conveys when the bonus mode time period is activated and indicator 320 conveys a bonus winner message when an eligible machine receives a bonus award. It is to be expressly understood that indicators 300, 310 and 320 could be of any type such as visual displays, audible indicators, or a combination of both which could be incorporated into a machine, on a machine, or near a machine as a single display or as multiple displays. A single display could be used such as a digital display to exhibit all three indicators rather than having separate displays. In the preferred embodiment, backlit slot glass is used. The type of indication is immaterial to the teachings of the present invention.

The messages conveyed by indicators 300, 310, and 320 are important. It is important that an eligible player E be continually aware of eligibility status with indicator 300. It is also important than an eligible player E is immediately informed of when a bonus mode time period is started 248 (and ended 260) with indicator 310 and to be immediately informed when he or she receives a bonus award 254 with indicator 320. These indicators 300, 310, and 320 are oriented to be in a position such that the eligible player can easily receive the desired message. This may be accomplished by turning lights on, flashing lights, sounding alarms, etc.

Within each gaming machine G are conventional signals indicating start of play S in the gaming machine and a play over signal O when the game being played in a machine is over (and whether the player has won or lost the game). These signals are conventionally delivered over a network 202*b* to the controller 200 of the present invention.

Figure 4:
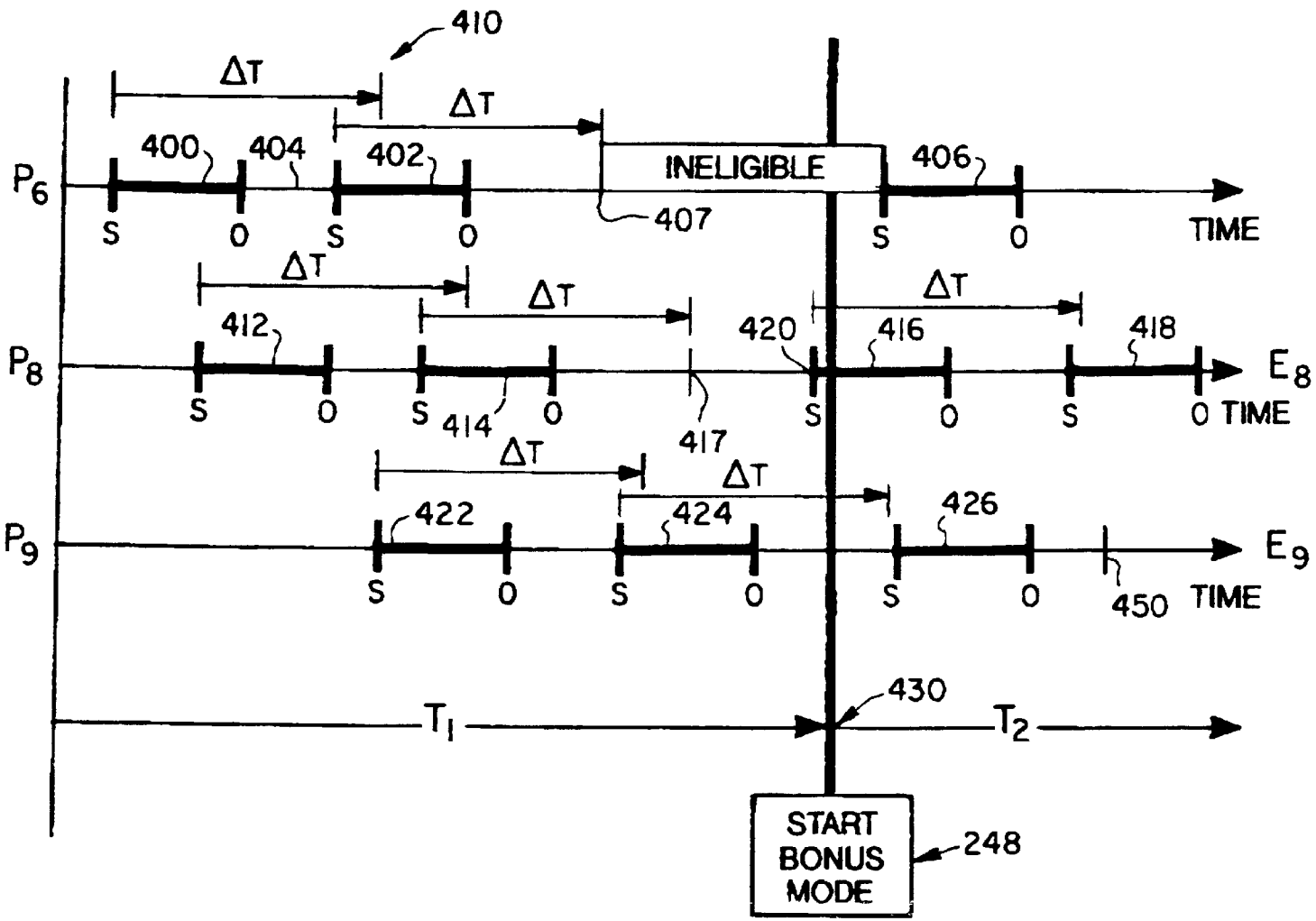
FIG. 4 sets forth the timing, in an example of three players, for establishing player eligibility.

Under the teachings of the present invention, a timer function 350 in controller 200 (which can be computer generated) receives the play start signal S from the interface board 330 over network 202*b*. The timer function 350 continually determines player eligibility and activates indicator 300 as a player starts S play at a gaming machine and for a ΔT time period thereafter. FIG. 4 is an illustration of several game play sequences corresponding to the players P at machines G illustrated in FIG. 2. The timer 350 could also be located at the I/O board 370 to control eligibility.

In FIG. 4, the determination of player eligibility is illustrated with respect to FIG. 2 for the on-going example. Players P6, P8 and P9 of FIG. 2 have their gaming activity at gaming machines G6, G8, and G9, respectively shown. Player P6 sitting at game G6 during time interval $T_1$ (i.e., configuration 230A) plays two games 400 and 402. The start S of each game is shown as well as when the game is over O. Between game plays 400 and 402 is an interval time 404 during which player P6 inserts a monetary amount in the form of unit bets. The time period 404 is variable depending on the desires of the player. It is this variability that is important under the teachings of the present invention. Player P6 can then play the game (for example activating handle 6 in the '909 patent).

It is to be understood that under the teachings of the present invention, the controller 200 determines the eligibility of the gaming machine by continually sensing a predetermined time frame ΔT after game play has started S. The game play referred to herein is the game at the gaming machine such as, for example, slots.

As shown in FIG. 3*a*, when a gaming machine G generates the play start signal S, the interface board 330 in a conventional manner (such as when polled) delivers this to the controller. A timer function 350 in controller 200 is activated which causes a predetermined time period ΔT to time out after game start S. This ΔT time period is predetermined and is fixed, although the amount of time can be set by the operator of the controller 200 of the present invention to any predetermined value. In the preferred embodiment, this time period is typically in the range of 8–15 seconds. Typically, a reel-type slot game is played in four seconds. Referring back to FIG. 3*a*, the game start signal S from the gaming machine activates the timer function 350. Controller 200 over network 202*a* causes indicator 300 to be activated over line 372 thereby informing the player that the player is eligible for the bonus mode. The eligibility indicator 300 continues to stay on for a ΔT time period after the game start signal S is detected. During the ΔT time period 410, as shown in the example of FIG. 4, the start signal S is detected by the controller 200 from player P6 as the player P6 starts playing game 402 which restarts the ΔT time period. Player P6 then completes game 402. However, as shown in FIG. 4, the player P6 does not start S the next game 406 within the prior ΔT time period so that the start signal S for game 406 occurs after the prior ΔT time period expires. Hence, at time 407, the eligibility indicator 300 is deactivated by the controller 200 and player P6 is no longer eligible. Eligibility for player P6 occurs only when the controller 200 receives the start signal S for the next game 406 within the prior ΔT time period. This did not occur for player P6. As shown in FIG. 4, player P6 has a period of time (i.e., between time 407 and the start S of game 406) in which the player P6 is ineligible to play in the bonus mode of the present invention.

Player P8 is shown in FIG. 4 playing four games, 412, 414, 416, and 418 on gaming machine G8. Player P8 remains eligible during games 412 and 414 since player P8 starts S game 414 within the predetermined ΔT time period after the prior game 412 is started S. However, as shown in FIG. 4, player P8 fails to start S game 416 within the ΔT time frame after game 414 is started S. Hence, at time 417, the eligible indicator 300 for gaming machine G8 is deactivated by the controller 200. This immediately informs player P8 that he or she is no longer eligible to play in the bonus mode time period should it occur. Player P8 starts S game 416 at time 420. This restarts the ΔT time period. At time 420, the eligible indicator 300 is reactivated and the player is again eligible for the bonus mode. Note that player P8 starts S game 416 at time 420. Under this example, it is the entry of the monetary value by player P8 into gaming machine G8 for game 416 that causes the current value 220 to be equal 246 to the bonus mode activation trigger 218. The receipt of the monetary value bet by player P8 at gaming machine G8 is sensed by the contribution function 240 of the controller 200 and the controller 200 increments 244 the current value 220 which now causes the start 248 of the bonus mode time period at time 430. The bonus mode start 248 function causes an eligibility lock 262 to occur which locks in those machines that are eligible. An eligible machine is a machine that is within the ΔT time period at the time of bonus mode start 248. When the bonus mode starts 248, the controller 200 determines eligibility and those machines that have their eligible indicators 300 activated are eligible when the bonus mode time period is started 248. Player P6, in this example, is not eligible at time 430 and is locked-out of the bonus mode play although he or she can still play a number of conventional games on machine G6 such as game 406.

One of the features of the present invention is to announce at time 430 to persons in the area of the island 230 and to all players at all gaming machines contained therein that the bonus mode has been entered. This is usually done by audio sounds such as music, visual indicators such as flashing lights or the lighting of lights and the like. The purpose of such celebration (visually and audibly) is to attract other persons in the vicinity of the island 230 to witness the distribution of numerous bonus jackpots during the bonus mode time period. This will be discussed later.

Each player P at a gaming machine G during time $T_1$ always knows whether or not they are eligible since their eligible indicator 300 is activated. With respect to the example in FIG. 4, player P6 knows that she has lost eligibility since her eligible indicator 300 is not activated at time 407 well prior to time 430. Even though player P6 starts S game 406 by entering a monetary value, her gaming machine G6 will be locked out from the bonus mode by function 262. This is an important feature of the present invention since it is a goal of the present invention to reward eligible players who promptly continue play of their gaming machines within the predetermined ΔT time frame 410 after each game is started S. Eligibility is important since it allows those players who promptly play their machines to be entitled to the bonus jackpots during the bonus mode time period. Eligibility is also important to stop slot cheats. Hence, player P6 and with reference back to FIG. 2, player P12 at time 430 are rendered ineligible at time $T_2$ even though they can continue to play the conventional game on their machines. The other unplayed gaming machines are also locked out such as G5 and G7. Players can sit and commence play at those machines during the bonus mode time period, but are not eligible for the bonus jackpots. The eligible players at time $T_2$ in FIG. 2 are termed E1, E3, E4, E8, E9 and E10 and only their respective gaming machines G1, G3, G4, G8, G9, and G10 are allowed to participate in the bonus mode time period. All of the other gaming machines can be conventionally played in the configuration 230 but are locked-out and cannot participate for bonus jackpots.

Note that player P8 is the player who upon insertion of the monetary amount into his or her gaming machine G8 caused the controller 200 to start 248 the bonus mode. However, in the preferred embodiment, player P8 does not receive an award or prize or other types of jackpot for causing this event to happen. In the preferred embodiment, all eligible players are locked in for the duration of the bonus mode.

Player P9 plays gaming machine G9 as shown in FIG. 4. Player P9 starts S her first game 422 and then starts S the play of her second game 424 before the expiration of the ΔT time period. The eligible indicator 300 for machine G9 remains activated for the ΔT time period for the second game 424 even though player P9 has not started S game 426 until after time 430. Player P9 becomes an eligible player and her gaming machine G9 is locked-in.

To summarize at time 430, gaming machine G6 is not eligible and is locked-out whereas machines G8 and G9 are eligible and locked-in. During the bonus mode time period $T_2$, all eligible machines in the preferred embodiment remain eligible whether or not a player starts the next game within a predetermined time frame ΔT after the prior game. Hence, player P9 could walk away from gaming machine G9 at time 450. Another person can sit down at eligible machine G9 and continue to play in the bonus mode time period. During the bonus mode time period (from start 248 to end 260), both indicators 300 and 310 are activated. Other embodiments of the present invention could require eligibility to be maintained during the bonus time period. For example, the ΔT time periods could be maintained so that if a player did not start S a game within the ΔT time, the machine would lose the right to continued participation in the bonus mode. Or, in another example, the eligible players could be required to always place maximum bets and should other than a maximum bet be placed the right to continued participation in the bonus mode would be lost. Or, the aforesaid examples could be combined.

Once the bonus mode time period has been started 248 at time 430, all eligible machines are locked in and only those machines are entitled to bonus jackpots during the bonus mode time period. Both eligible and ineligible gaming machines can be played conventionally. It is to be expressly understood that this is a preferred embodiment of using ΔT to determine eligibility at bonus mode start 248 and that variations to determining eligibility could take place. Eligibility can be based upon other conventional conditions at the gaming machine such as the insertion of a player tracking card, in which case eligibility is lost when the card is removed. Hence, at bonus mode start all machines having player tracking cards inserted are eligible. Eligibility could also be determined by requiring all players bet maximum bets during the ΔT time frame.

In summary, gaming machine eligibility (therefore, player eligibility) is determined by the controller 200 of the present invention by locking-in only those gaming machines that are currently within a predetermined time period ΔT after a game is started S. This determination could also be made by locking out those gaming machines that are ineligible.

It is to be expressly understood that the preferred embodiment provides a ΔT time period commencing from the start S of a game. However, the ΔT time period could also be measured starting from when a game is over O. In which case, eligibility is determined from sensing O to the end of the ΔT time period. Furthermore, the timing function could be located in the interface board 330 at each gaming machine G rather than in the controller 200.

In FIG. 2, the eligible players E operating eligible machines in time $T_2$ can continue to play both the conventional game at the gaming machines and also participate in the bonus mode time period. The remaining players such as P6 and P12, who are not eligible, can still play the conventional game and players can operate the other ineligible machines (e.g., G2, G5, G7, and G11) in conventional fashion.

Figure 3B:
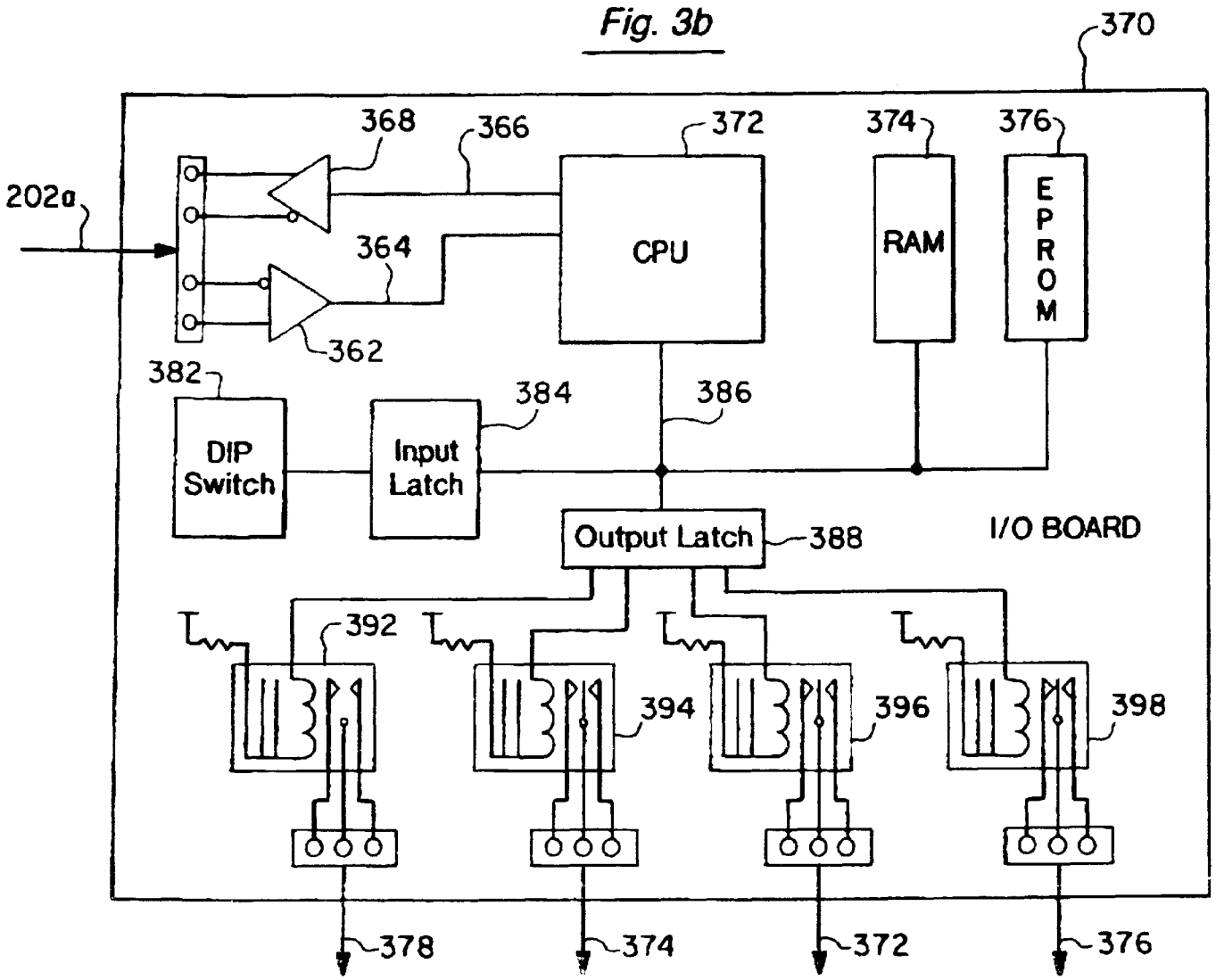

FIG. 3*b*, sets forth the details of the I/O board 370, which is interconnected over network 202*a* to the controller 200. In the preferred embodiment, the network connection 202*a* is a serial interface over which serial digital signals are delivered from the controller 200 to the I/O board 370 through buffer 362 and over lines 364 to an internal CPU 372. The CPU 372 can communicate over lines 366 and through buffer 368 with controller 200. Communication protocols are numerous and well known in the art for communications between controllers 200 and on board computers 372. On the I/O board 370 is also a random access memory (RAM) 374 and erasable programmable read only memory (EPROM) 376 which are also conventional in the art for storing permanent and temporary programming information to control the operation of the I/O card 370 and to effectuate communication between the controller 200 and the CPU 372.

Also on board 370 is a DIP switch 382, which is interconnected to an input latch 384 and communicates with the CPU 372 over bus 386. The CPU also communicates over the bus 386 with the RAM 374 and the EPROM 376 as well as an output latch 388. The purpose of the DIP switch 382 is to provide a unique code to identify the machine G at which the I/O board 370 is located. The CPU 372 provides this unique machine code in its communications to and from the controller 200.

The output latch 388 is interconnected to relays 392, 394, 396 and 398 which are utilized to drive respectively, tower lamp 380 over lines 378, the bonus mode indicator 310 over lines 374, the eligible indicator 300 over lines 372, and the bonus winner indicator 320 over lines 376. The above represents only a preferred embodiment and, it is to be expressly understood, that many other equivalent circuit approaches could be utilized to identify the gaming machine and to activate the indicators 300, 310, 320 and 380.

5. Random Selection of Eligible Gaming Machines

With reference back to FIG. 2, when the bonus mode start 248 occurs the controller 200 issues a bonus mode signal 261 to the eligibility lock function 262 which locks-in the eligible gaming machines. In addition, signal 261 activates a delay trigger function 264 to delay the award of bonus awards by a time period. In the preferred embodiment, this is a fixed time delay. In other words, the purpose of function 264 is to delay the award of any bonus awards by the controller 200 for a short predetermined period of time after the system locks-in the eligible machines and activates the bonus mode indicators 310. The controller 200 of the present invention then determines, on a random basis, which eligible machines are to receive bonus jackpots.

The controller of the present invention 200 must now randomly choose which of the eligible machines will receive the bonus jackpots during the bonus mode time period. In essence, the bonus jackpots are a series of miniature random controller-based jackpots. In the on-going example, an island 230 of FIG. 2 has K machines with eight players playing eight gaming machines. As discussed above, six machines of the eight are eligible (i.e., G1, G3, G4, G8, G9, and G10) to play in the bonus mode at the start 248 of the bonus mode (time 430 in FIG. 4) which is shown as configuration 230B. The system 200 of the present invention uses the random player selector 270 to pick different ones of the six eligible machines on a random time basis for each random bonus award. The controller 200 as shown by dotted lines 272 knows the identity of all eligible machines.

Figure 5:
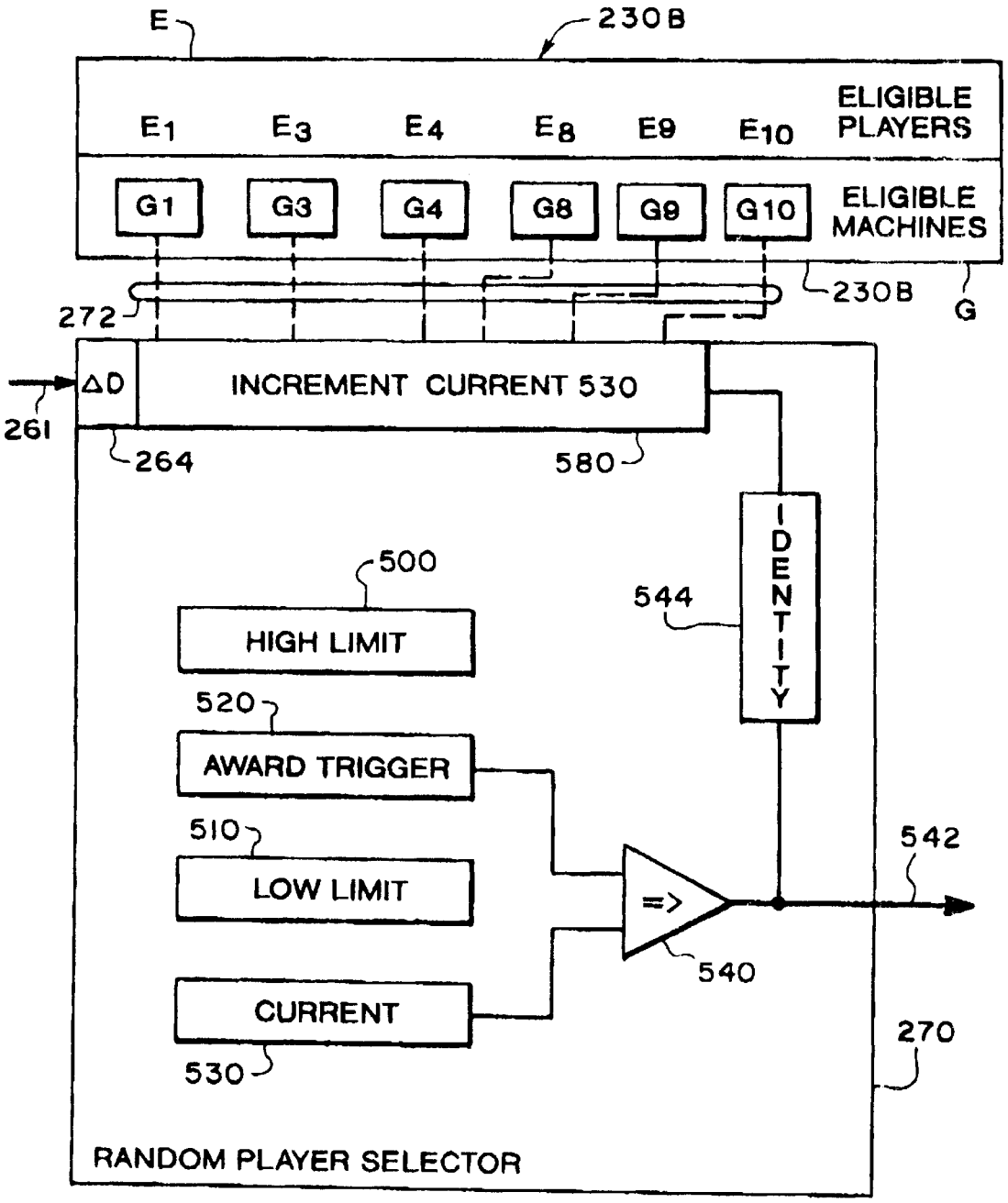
FIG. 5 sets forth the functional block diagram of the random selection of an eligible gaming machine during the bonus mode of the present invention.

FIG. 5 illustrates the functional operation of the random selector 270 in FIG. 2. The purpose of the random selector 270 is to provide the random selection of eligible gaming machines (and therefore eligible players) to award bonus jackpots.

In FIG. 5, a high limit value 500 and a low limit value 510 are provided. Again, these functions can be implemented in software, hardware, or both. In the preferred embodiment, the high limit value 500 is equal to:

J×N×max coin setting.

The low limit value 510 is equal to:

K×N×max coin setting.

The number of eligible machines corresponds to N. In the preferred embodiment J=3 and K=2, although any suitable integer could be used. The "max coin setting" corresponds to the maximum coin setting of the gaming machines G. For the example of FIG. 2, a common dollar reel-type slot machine has three dollar coins for the maximum coin bet. Hence, in the example the number of eligible machines is 6 (i.e., N=6), and the max coin setting is equal to 3, then a high limit value 500 equals 3 times 6 times 3 or 54, and the low limit 510 equals 2 times 6 times 3 or 36. The controller 200 of the present invention counts the number of eligible machines and arrives at the value for N, and then determines the high limit 500 and the low limit 510 in response to the start 248 of the bonus mode time period. These determinations are used by the linked random jackpot controller-based system 200 of the present invention for a single bonus mode time period, but is recalculated for each new bonus mode time period.

The controller 200 of the present invention, using a conventional random number generator located therein, then derives an award trigger 520 randomly between the high limit 500 and the low limit 510. This adds a further randomness to the game of the present invention and ensures fair selection from all eligible players based upon rate of play. The current value 530 in the random selector 270 can be initially set to any suitable value, preferably zero. If set to zero, at the start 248 of the bonus mode (time 430 in FIG. 4), the controller 200 monitors the unit bets from each eligible gaming machine as shown by dotted lines 272 and each unit bet increments 580 the current value 530 by one. It is important to keep in mind that the non-eligible gaming machines may be conventionally played, but the unit bet signals from those ineligible machines are not sensed by the increment current function 580. Only the eligible machines as they are conventionally played, have their unit bets sensed by function 580 to increment the current value 530 in the random selector 270.

When the increment current function 580 commences to start counting the unit bets from the eligible machines is set by the operator of the system of the present invention. Typically, a delay 264 (also termed ΔD), such as 5–10 seconds is incorporated. This is an optional feature. It is to be expressly understood that the increment current function 580 can commence immediately without delay or have a fixed delay 264 set by the operator, or any other suitable determination. The ΔD time period 264 allows the casino to extend the bonus mode time period without costing the house. The ΔD time period 264 also provides a "relaxation period" for the players.

When the current value 530 equals or exceeds 540 the award trigger 520, through incrementation 580, the controller at 542 enters the jackpot winner selection process 290 of FIG. 2. The gaming machine which causes the current value 530 to equal 540 the award trigger 520 is identified 544 and delivered 542 to jackpot winner selection process 290.

Figure 6:
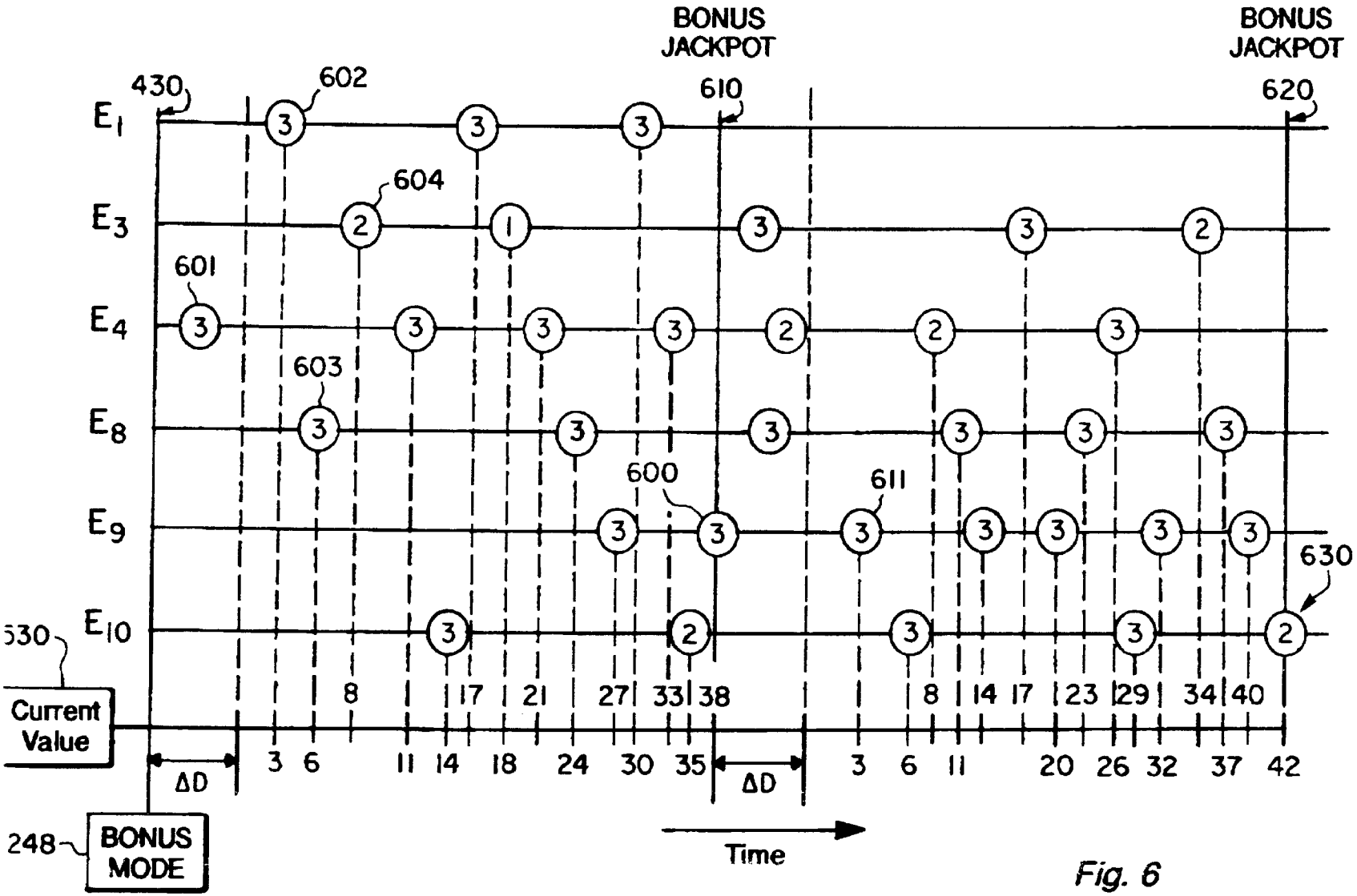
FIG. 6 sets forth the timing among six gaming machines, in an example, of determining which eligible gaming machine receives a bonus award.

This portion of the operation of the controller 200 in the present invention is functionally shown in FIG. 5 with reference to FIG. 6. In FIG. 6, two bonus jackpots 610 and 620 in a bonus mode time period starting at time 430 are issued to randomly selected eligible machines. FIG. 6 further illustrates the operation of the present invention with the on-going example. The bonus mode start signal 261 is issued at time 430 and with reference back to FIGS. 2 and 5, the following are the eligible machines: G1, G3, G4, G8, G9, and G10 being played by eligible players E1, E3, E4, E8, E9 and E10. At time 430, there are six eligible players (N=6). As previously discussed, the high limit 500 equals 3 times 6 times 3 or 54, and the low limit 510 equals 2 times 6 times 3 or 36. The controller 200 using a random number generator randomly picks the value for the award trigger 520 between 36 and 54. In the example shown in FIG. 6, the first randomly selected award trigger equals the value of thirty-seven. The controller 200 sets the current value 530 to zero at time 430.

Under the teachings of the present invention, during a first ΔD delay time 264, any unit bets made by eligible players E are ignored. Hence, player E4 at machine G4 has placed a three-dollar bet 601 and the unit bets of three are not counted. Counting commences after the ΔD delay and the first three-dollar bet 602 by player E1 is counted and is shown on the current value 530 line as 3. Next player E8 places a three-dollar bet 603 so the current value 530 is now 6 due to the operation of the increment function 580. Next, player E3 places a two-dollar bet 604 and the current value 540 equals 8, and so on. One player, E9, subsequently at time 610, makes a three-dollar bet 600, the current value 530 now equals 38 which equals or exceeds 540 the award trigger value of thirty-seven, thereby causing a signal 542 to be issued from the random player selector 270 to the jackpot winner selection process. The eligible machine G9 is identified 544 by the controller 200 as being responsible for the issuance of signal 542. As will be described subsequently, gaming machine G9 will automatically 254 receive a bonus jackpot.

The system 200 enters the second bonus jackpot round at time 610. During the ΔD delay period unit bets from eligible players E3, E4, and E8 are not counted. Counting starts with eligible player E9, making a three-dollar bet 611. In this second bonus jackpot round, the high and low limits 500 and 510 remain the same. The controller 200 selects a new random value for the award trigger 520, which, in this example, is forty-two. The current value 530 is reset to zero. Hence, the process repeats with the increment current function 580 continually adding each unit bet to the current value 530. When machine E10 at time 630 inserts two dollar coins, the current value 530 equals the award trigger 520, signal 542 issues, and the system 200 identifies eligible gaming machine G10 as winning the second bonus jackpot.

In this fashion, each bonus jackpot during the bonus mode time period is randomly, in time and through play, given to one of the eligible machines. What that machine is and when the award will be given is indeterminent and random. When a bonus jackpot is given, and with reference back to FIG. 3, bonus winner indicator 320 of the winning eligible machine is activated to inform that eligible player of winning a bonus jackpot. In addition, other indicators, such as a tower lamp 380 on top of the eligible machine may also be activated to flash so that people witnessing the game and other players can see who won the bonus award. Indeed, under the teachings of the present invention, an announcement may be made to all within the vicinity of the island 230 that a bonus jackpot has been given so that people can see which player receives the bonus jackpot.

While the above represents a preferred approach to randomly selecting a player for a bonus jackpot, it is to be expressly understood that any of a number of equivalent ways could be use. The preferred embodiment, however, adds excitement and incentive for an eligible player to continually play the maximum number of coins (i.e., unit bets) as fast as each game can be played. Even though the player selection is random, both in time and in identity, playing the maximum coin insert rather than a single coin insert and playing as rapidly as possible, increases the odds that that player may be the player to bring the current value 530 equal to the award trigger 520. It is to be understood that the use of "counting coins" is for illustrative purposes only and that, as mentioned, the monetary value can be inserted (or actually in the machine) in any one of a number of conventional approaches.

Clearly, if a player E who is eligible sits at an eligible gaming machine G, and does not place any unit bets, that player will never be selected to receive a bonus jackpot. All eligible players who conventionally play, however, have a sense of group participation. They are in a race against each other to quickly place bets so as to be selected for the bonus jackpots.

It is important to note that the controller 200 counts the unit bets in making the random selection 270. Hence, whether the controller 200 is counting the unit bets of one dollar or units bets of twenty-five cents is immaterial. It is the count of the unit bet that occurs in the preferred embodiment not the actual value. However, it can be appreciated that the same approach as discussed for triggering the bonus mode (i.e., contributions based upon entry of monetary amount) could be used to make the random selection.

Note that is possible that two players may simultaneously bet, but the controller 200 awards only one bonus award when that occurs. In the preferred embodiment, and as shown in FIG. 2, poller 255 sequentially polls each machine to receive the unit bet information. Hence, in the case of bets placed simultaneously by players at gaming machines G, only one player (i.e., the first player to be polled) is selected when that player's bet causes function 540 to become activated.

In summary, it can be observed that the bonus awards are randomly made by the controller-based system 200, both in time and in selection of the gaming machine. Eligible players at the gaming machines cannot predict when and who will be awarded a bonus award. The approach set forth with respect to FIG. 6 is the preferred approach for randomly selecting an individual eligible gaming machine for a bonus jackpot.

As with FIG. 2, FIG. 5 is neither a schematic or a software flow chart. FIG. 5 is a functional presentation showing the operation of the controller. As such, the components (such as 580, 510, etc.) and the interconnecting lines (such as 542) are part of the functional operation which are to be implemented into a conventional CPU and its associated memory and communications packages.

6. Random Selection of Bonus Awards

In FIG. 2, a random payout selector 292 in the controller 200 is disclosed using a weighted payout table 294. The random payout selector 292 randomly selects, in the preferred embodiment, one out of eight weighted payouts from table 294. Any value could be used for the number of weighted payouts and in the example J=8. An example of a weighted payout table is set forth in the following table for the dollar gaming machines G of the ongoing example:

TABLE I

| PAY | WEIGHT |
|---|---|
| $5 | 50.40% |
| $10 | 25.00% |
| $25 | 12.50% |
| $50 | 6.25% |
| $75 | 3.12% |
| $100 | 1.56% |
| $250 | 0.78% |
| $1,000 | 0.39% |
| Total: | 100% |

The controller-based system 200 as discussed above with respect to FIG. 5 generates a signal 542 at times 610 and 620 (shown in FIG. 6) from the random player selector 270 to the jackpot winner selection process 290, as shown in FIG. 2. In the preferred embodiment, the random payout selector 292 continuously operates at a selection speed of 20,000/second so as to have weighted payouts continually available. While this speed is preferred, any suitable speed could be used. In response to signal 542, process 290 receives a weighted payout 296 from the random payout selector 292.

An example of a weighted payout table appears in Table I above. The value of the payout in Table I can be any suitable range of values. Each payout is given a "weight." The "weight" is the frequency that the payout is given. Hence, the five-dollar payout is given 50.4 percent of the time, the ten-dollar payout is given 25 percent of the time. The jackpot of $1,000 is given is given out 0.39 percent of the time. Again, the weights can be any suitable percentage or range of percentages as long as they total 100%. The design of the payout amounts (pay 1 through pay J) and the weights (i.e., weight 1 through weight J) are designed for the jackpot game of the present invention and are based upon the contribution collected 240 so as to make the game fair to the player yet profitable to the operator of the game. Based upon the weighted percentage payouts, as illustrated in Table I above, the most frequent payouts are: five dollars, ten dollars, twenty-five dollars, and fifty dollars. Less frequent payouts are: seventy-five dollars, one hundred dollars, two hundred fifty dollars, and one thousand dollars.

When a bonus award (or payout) is made by the jackpot winner selection process 290, the bonus jackpot amount is delivered 298 to the "pay winner" function 254 which immediately credits over network 202*b* the amount in the credit register 390 (see FIG. 3*a*) of the identified winning eligible machine before the conventional game ends. The indicator 320 is activated so that the player is informed of the win and how much has been won while playing the conventional game. This adds further excitement to the player. Likewise, that amount 298 is used by the decrement current function 256 to decrement the current value (or jackpot pool) 220. This process, as previously discussed for FIG. 2, continues until the value in the current value (or jackpot pool) 220 equals or drops below zero to end 260 the bonus mode time period.

It is to be expressly understood that the weighted payout table shown in Table I is only an example. In operation, the controller 200 is fully programmable by the operator to provide hit frequencies and payout jackpots of any value.

Because the award of bonus jackpots are determined by the controller 200 of the present invention, the conventional game play, on either eligible or ineligible gaming machines, is wholly unaffected.

The following three games illustrate the operation of the weighted payout table 294 in conjunction with the operation of the decrement current function 256 on the current value (or jackpot pool) 220.

Game I illustrates a typical game having eleven bonus jackpot rounds during a single bonus mode time period. FIG. 6 only illustrates the first two bonus jackpots or rounds 610 and 620. The bonus mode time period starts 248 with the current value 220 equaling or exceeding 246 the bonus mode trigger 218 of $200. The current value or jackpot pool is set to the trigger value 218 of $200. If the current value 220 at the start 248 exceeds the trigger value 218, the excess is set aside as will be more fully explained later.

GAME I

| BONUS AWARD ROUND | PAYOUT VALUE 298 (DOLLARS) | CURRENT VALUE JACKPOT 220 (DOLLARS) | FUNCTION 258 |
|---|---|---|---|
| | | $200 | |
| 1 | 5 | 195 | |
| 2 | 50 | 145 | |
| 3 | 5 | 140 | |
| 4 | 5 | 135 | |
| 5 | 10 | 125 | |
| 6 | 25 | 100 | |
| 7 | 5 | 95 | |
| 8 | 5 | 90 | |
| 9 | 10 | 80 | |
| 10 | 5 | 75 | |
| 11 | 10 | 65 | |
| 12 | 5 | 60 | |
| 13 | 5 | 55 | |
| 14 | 50 | 5 | |
| 15 | 10 | −5 | 0 |

In Game I, and with reference to FIG. 6, if in jackpot round number 1 (corresponding to bonus jackpot 610 in FIG. 6), eligible player E9 wins five dollars. Eligible player E9 has his bonus winner indicator 320 activated and his credit register 390 (as shown in FIG. 3) automatically incremented 254 by the controller 200 of the present invention by five dollars. As this occurs, the decrement current function 256 in the controller 200 causes the value in the current value (jackpot pool) 220 to be decremented by five dollars or to $195. This process continues until the current value (jackpot pool) 220 is equal to or less than zero. Hence, in bonus award round 15 of Game I, the jackpot payout value 298 of ten dollars causes the current value (jackpot pool) 220 to become a negative five dollars and function 258 detects this and the controller causes the bonus mode time period to end 260. Game I of the present invention is now over.

As previously discussed, the current value 220 now has a value of a negative five dollars which is used for the initial current value for the next game cycle of the present invention.

The controller 200 of the present invention randomly picks a new bonus mode activation trigger 218, which for Game II is one hundred fifty dollars. The controller 200 collects contributions 240 to increment 244 the current value 220 until the current value 220 equals or exceeds 246 the bonus mode activation trigger 218 to start 248 a new bonus mode time period. The current value (jackpot pool) 220 is set to the trigger value 218 of one hundred fifty dollars and any excess in the current value 220 is set aside. Game II is illustrated below:

GAME II

| BONUS AWARD ROUND | PAYOUT VALUE 298 (DOLLARS) | CURRENT VALUE JACKPOT 220 (DOLLARS) | FUNCTION 258 |
|---|---|---|---|
| | | 150 | |
| 1 | 5 | 145 | |
| 2 | 5 | 140 | |
| 3 | 25 | 115 | |
| 4 | 5 | 110 | |
| 5 | 10 | 100 | |
| 6 | 10 | 90 | |
| 7 | 100 | −10 | |

The bonus mode time period for Game II starts with the first bonus award round paying five dollars to the surprised player who is randomly selected. The current value register 220 is reduced by five dollars from one hundred fifty dollars to one hundred forty five dollars. This process continues until round 7 where the eligible gaming machine randomly selected for the payout of one hundred dollars suddenly causes the current value 220 to be reduced from ninety dollars to minus ten dollars which causes it to drop below zero. The bonus mode time period for Game II of the present invention is now ended 260. For each jackpot payout, a different machine G is randomly selected by process 270 in controller 200. It is possible that the same machine may be randomly selected more than once in a game.

For Game III the system 200 of the present invention uses the current value 220 of minus ten dollars for Game II as the initial current value 220 for Game III plus the base value, which in this example is set to zero. Hence, in Game II, the contributions are collected 240 to increase 244 the current value 220 from minus ten dollars to the newly randomly selected trigger value 218, which is illustrated in Game III below to be one hundred seventy five dollars.

GAME III

| BONUS AWARD ROUND | PAYOUT VALUE 298 (DOLLARS) | CURRENT VALUE JACKPOT 220 (DOLLARS) | FUNCTION 258 |
|---|---|---|---|
| | | 175 | |
| 1 | 1000 | −825 | 0 |

In Game III, one thousand dollars is hit on the first round to a randomly selected eligible gaming machine. This immediately causes the initial current value 220 to drop to minus eight hundred twenty five dollars which is well below zero. The bonus mode for Game III ends 260 in the first bonus award round.

For the next game the current value 220 from Game III of minus eight hundred twenty five dollars is used and the process of collecting contributions 240 incrementing 244 until the current value 220 equals the bonus mode value 218 occurs. This will take a period of time to accomplish.

The preferred embodiment of the present invention always fully pays the "negative" value that the jackpot pool has before the next bonus mode is started 248. The fact that the "negative value" is different from game to game of the present invention and becomes the current value for use in eventually triggering the next bonus mode start 248 adds to the randomness and unpredictability of the present invention. It is to be understood that from time to time a "negative value" is not obtained since it is possible the current value at the end of a bonus time equals zero.

In the random payout selection process 292, it is apparent from the above, that the controller 200 of the present invention randomly selects a weighted payout from a weighted payout table 294 for each bonus jackpot. The use of a weighted payout table 294 is preferred, but optional under the teachings of the present invention. Any payout schedule based on the use of a random number generator in the controller could be utilized under the teachings of the present invention. Furthermore, providing a fixed value such as $10 for each bonus jackpot or a sequence of fixed values such as $50, $25, $10, $5, $1, $0.50, $0.25, etc., in lieu of a table could also be used.

7. Operating Environments

In FIGS. 7 and 9 the progressive gaming system 200 of the present invention is set forth in a first operating environment embodiment. In this embodiment, the gaming machines G are oriented around a circular frame 700. Audio and digital displays 710 are placed in a region on the frame 700 near the gaming machines G. A sound and light show can be generated from the center 720 of the circular frame 700, which can include audio, visual, mechanical effects or a combination thereof. In FIG. 9, a computer 900 is shown which interconnects with an audio system 910 and a visual display 920. The audio display 910 with reference back to FIG. 7 can comprise of a sound system located anywhere on the frame 700 or nearby. The visual display 920 can also be located in a pattern of digital displays, lights, etc. on or around the frame 700. The precise nature of the displays 910 and 920 is not important to the teachings of the present invention as those can be programmed into formats stored in memory 930. The object of the overhead signage, lights, sound, and graphics 910 and 920 is to provide the following display modes;

TABLE II

| MODE | START 248 | PAY WINNER 254 | END 260 |
|---|---|---|---|
| ATTRACT | OFF | OFF | ON |
| BONUS | ON | OFF | OFF |
| JACKPOT | ON | ON | OFF |

The "ATTRACT" mode set forth in Table II above is used to attract and advertise the game of FIG. 7 to prospective players. For example, an attract format stored in memory 930 might have an audio voice announce:

"Any coin might trigger the money!"

At the same time, the format 930 may have an overhead display 920 display "MONEYTIME". Additional graphics in display 920 could explain the rules of the game of the present invention.

During the "bonus" mode set forth in Table II above, the controller 200 has issued the start 248 signal, which indicates the start of the bonus mode time period. During the bonus mode time period, a second format can be selected from memory 930, which causes the audio 910 to announce "It's bonus time!" Music can be played which contributes to the excitement. In addition, the overhead meter 710, which forms part of the visual display 920, can be flashed with "dancing coins".

Finally, during the "jackpot" mode in Table II above, the start 248 has occurred and a pay winner 254 signal occurs indicating one of the eligible gaming machines has received a bonus award. During this mode the computer 900 selects a celebration format from memory 930 to drive audio system 910 and the visual display 920 celebrating with frenzy and fanfare that a player has won a bonus jackpot and stating the value of the jackpot.

Figure 8:
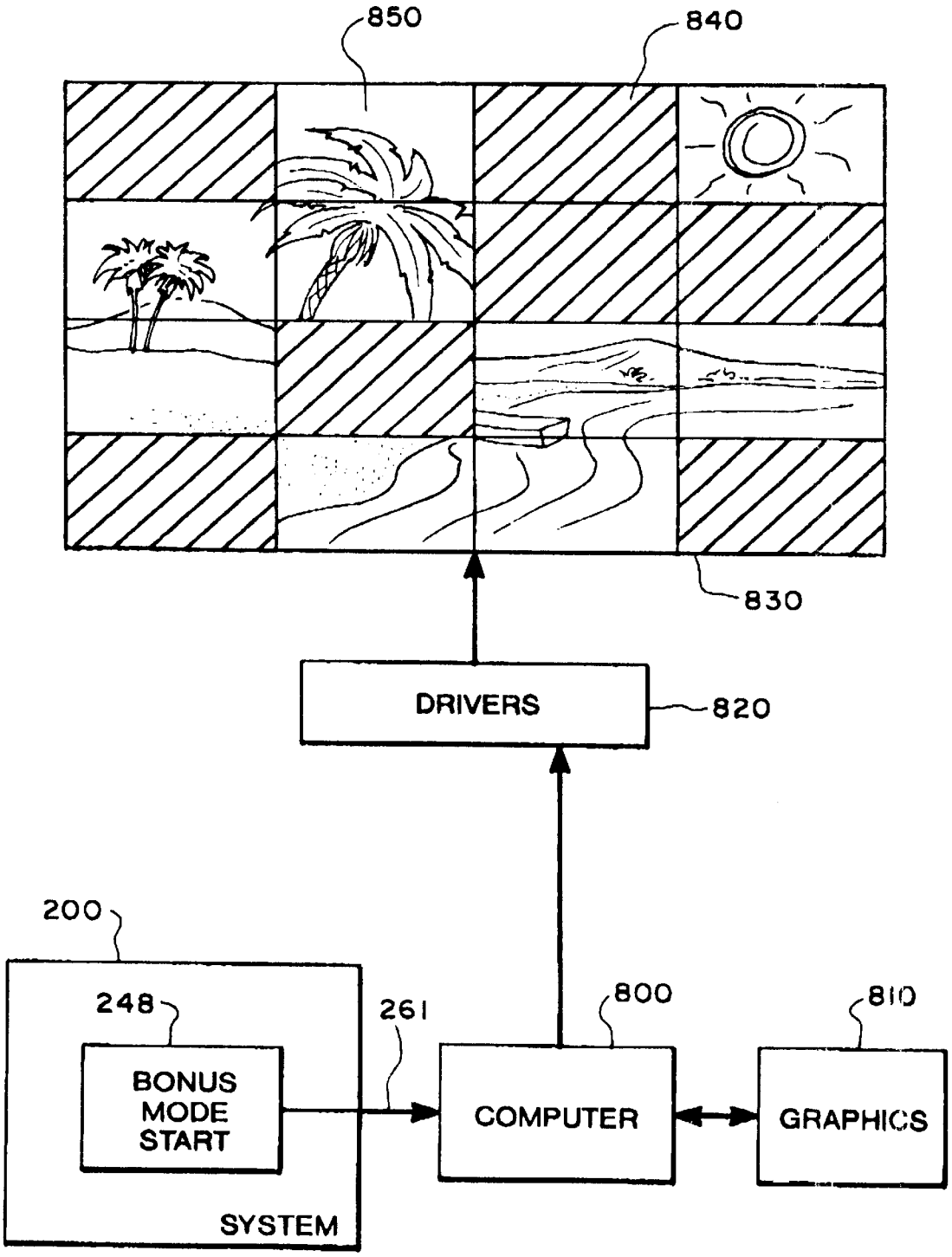
FIG. 8 sets forth an embodiment with the system of the present invention driving a jigsaw puzzle.

In FIG. 8 is set forth a second operating environment embodiment wherein the system 200 interfaces with a standard computer 800 having graphics memory 810 interconnected to a set of drivers 820 which in turn are interconnected with a display 830. The display 830 is large and can be positioned in the area around the controller 200 of the present invention such as near the island 230 of FIG. 2. It is to be expressly understood that the computer 800, graphics memory 810, driver 820 and display 830 are conventional. The computer 800 receives the start 261 signal from the bonus mode start 248, as previously discussed. When this signal 248 is detected, computer 800 operates as follows.

The display 830 is comprised of a plurality of segments 840. Each segment 840 could be in the shape of a square or rectangle as shown in FIG. 8 or in the shape of a standard jigsaw puzzle configuration. Each time the computer 800 receives signal 261 a new segment 840, on a random basis, is turned over to reveal a portion of a picture 850. If an eligible player is able to discern what the entire picture 850 is, then the player is entitled to yet another prize. This adds further excitement and attraction to the game.

It is to be expressly understood that the controller 200 and the computer systems shown in FIGS. 8 through 9 may all be implemented in the same computer controlled system 200. The embodiments shown in FIGS. 8 and 9 are illustrated using separate computers, which are specifically designed to handle large digital graphic and sound displays.

Figure 10:
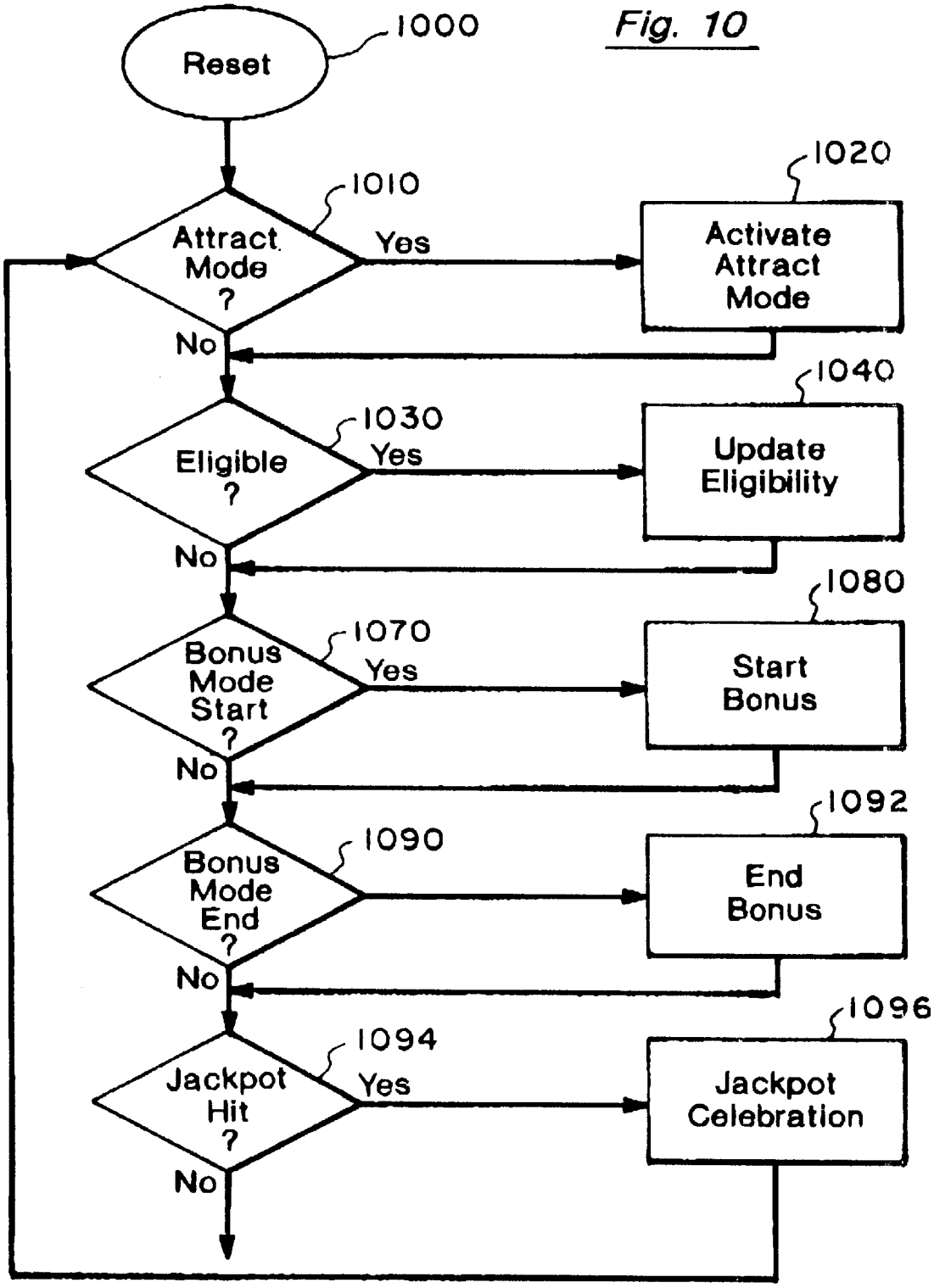
FIG. 10 sets forth a flow chart for the overall operation of the system of the present invention.

The overall operation of the controller-based linked random jackpot controller 200 of the present invention as shown in FIG. 2 is presented in FIG. 10. In FIG. 10, the system is initially reset in stage 1000. In stage 1010 the system ascertains whether it is still in the attract mode and whether the bonus mode is active. If the system is not in the bonus mode, then the process enters stage 1020 to activate the multimedia display in FIGS. 7 and 9 so as to attract players at the carousel 700 in FIG. 7. Stage 1030 is then entered wherein the system checks each gaming machine G to ascertain whether any eligibility status (see FIG. 4) has changed for any given machine. If the answer is yes, stage 1040 is entered wherein all eligible indicators 300 (FIG. 3) are updated as to eligibility. New gaming machines G that have become eligible have their eligibility indicator 300 activated in stage 1040 and gaming machines which lost eligibility have their indicators de-activated to indicate that they are no longer eligible. This was shown in FIG. 3 and fully discussed with respect to FIG. 4.

Stage 1070 is then entered. Stage 1070 inquires as to whether the bonus mode start 248 has occurred. If so, stage 1080 is entered and the system as shown in FIG. 9 over lines 248 starts the multimedia system through use of computer 900. This announces to all players that the bonus mode time period has started and the celebration commences. The bonus mode indicator 310 at each machine G is activated and the eligibility indicators 300 are locked on to be continually activated throughout the bonus mode time period. Stage 1090 is then entered to determine whether the bonus mode is over at stage 260 in FIG. 2. If the answer is yes, then stage 1092 is entered and the celebration is stopped by sending a signal 260 to the computer 900 as shown in FIG. 9 to stop the celebration. The bonus mode indicator 310 at each machine is de-activated and the eligibility indicators 300 are unlocked. Stage 1094 is then entered to ascertain whether or not a jackpot is hit. If it is hit, then the computer 900 is instructed over lines 254 to provide a jackpot celebration in stage 1096. In addition, the bonus winner indicator 320 at the winning machine is activated. This process then repeats at 1010.

Figure 11:
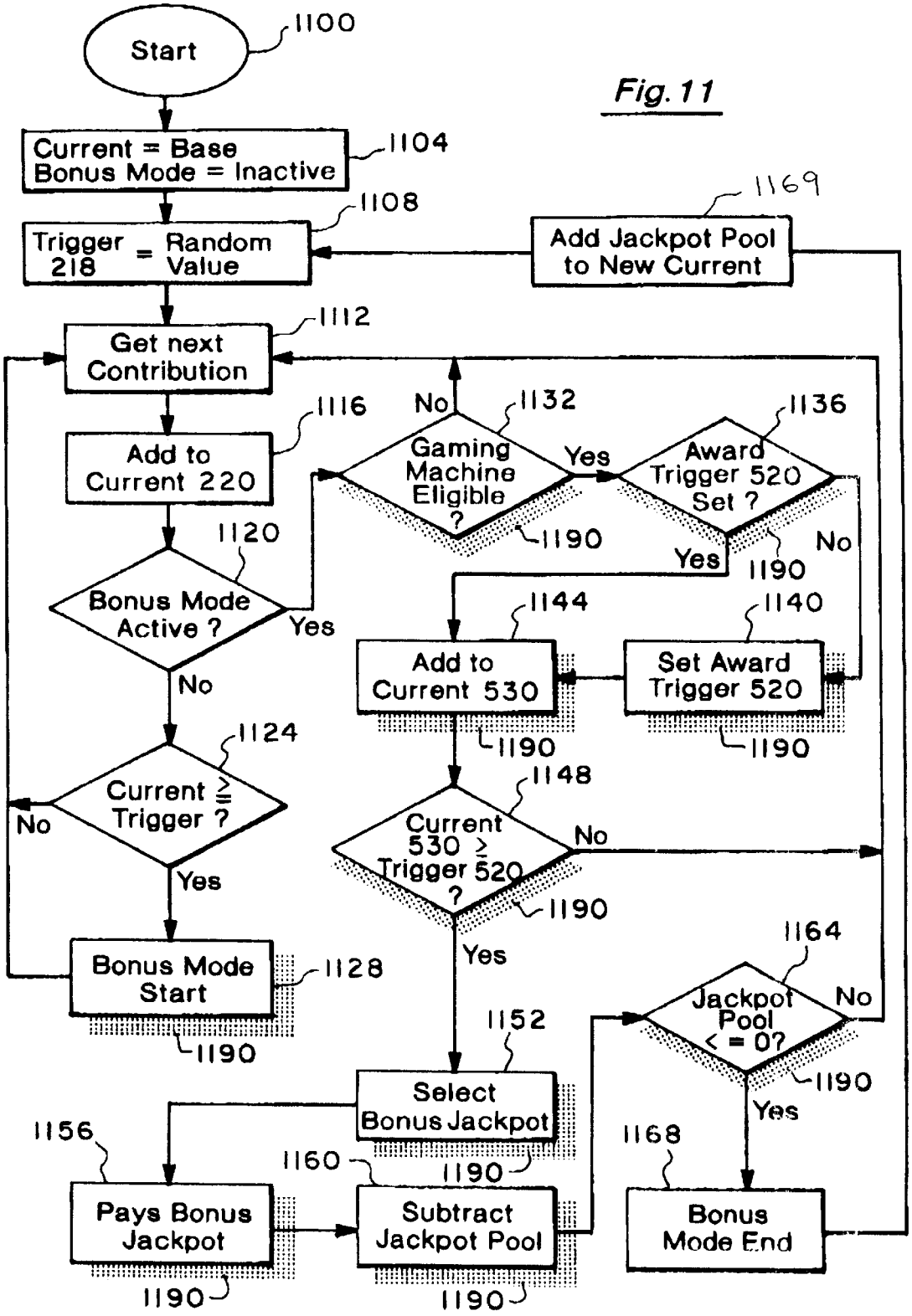
FIG. 11 sets forth the flow chart for entering the bonus mode and awarding bonus jackpots.

The flow chart for the functions discussed in FIG. 2 is set forth in FIG. 11. The controller 200 initializes and starts 1100 and then enters stage 1104 where the current value 220 is set equal to the base value 216 which in the preferred embodiment is zero. In addition, the bonus mode 248 is set to the inactive state. The system then enters stage 1108 wherein the bonus mode trigger 218 is set equal to a random value between the high limit 212 and the low limit 214. It is well known in the art how to pick random integers between the high limit 212 and the low limit 214. The random number generator (RNG) for this is in the controller 200. Polling stage 1112 is then entered which obtains the next contribution 242 via function 240 from the gaming machine being polled 255 where a monetary amount is entered (such as a percentage of the coins played such as is done in the '909 patent). In stage 1116, this contribution 240 is added to the current value 220. Stage 1120 is entered to ascertain whether the bonus mode is already active. If the bonus mode is not active, then stage 1124 is entered and a determination is made whether the current value 220 is greater than or equal to the bonus mode trigger 218. If not, stage 1112 is re-entered and the process continues to receive contributions 240 from each polled 255 gaming machine G for monetary values entered by players P until in stage 1124 the answer is yes.

In FIG. 11, the shaded operational areas 1190 indicate that the bonus mode is activated (i.e., bonus mode has started 248). The controller 200 then enters stage 1128. Here the bonus mode is started 248 and the controller 200 sets the bonus mode into the active state, the bonus jackpot pool is set equal to the value of the bonus mode trigger 218, the bonus mode timer ΔD 264 is started and the next current value 220 is set equal to the base value 216 (which is zero in the preferred embodiment) plus (the current value 220 minus the bonus mode trigger value 218). The value in parenthesis represents the excess discussed earlier, which corresponds to the contribution over the trigger value 218. For example, the current value 220 may exceed the trigger value 218 by $2 when the bonus mode is started 248, so the next current value 220 equals $2. The process then returns to stage 1112 wherein new contributions made during the current bonus mode time period are added 1116 to the next current value 220. Stage 1120 is then entered and since the bonus mode is active, stage 1132 is now entered. In stage 1132, a determination is made whether a particular gaming machine G being polled is eligible. If the gaming machine is not eligible, then stage 1112 is re-entered to poll for next machine. It is to be expressly understood that the controller polls 255 each machine G. If the gaming machine being polled is eligible, then stage 1136 is entered. In stage 1136, a determination is made as to whether the award trigger 520 has been made. If the answer is no, then stage 1140 is entered wherein (and as shown and discussed with respect to FIG. 5), the random value of the award trigger 520 is set between the high limit 500 and the low limit 510 by the controller 200 as shown in FIG. 5. At the same time the value of the current 530 is set equal to 0. Stage 1144 is then entered wherein any unit bets for that gaming machine G are counted and added to the current value 530 (as illustrated and discussed with respect to FIG. 6). It is to be understood that if in stage 1136, the next award trigger 520 had already been set then stage 1144 would have been directly entered.

Stage 1148 is entered to determine whether or not the current value 530 equals or exceeds the award trigger value 520. If the answer is no, then stage 1112 is entered for the next gaming machine in the polling process. The next gaming machine is then interrogated in the above-described fashion. However, if the current value 530 equals or exceeds the award trigger 520, then stage 1152 is entered. In stage 1152, the random payout selector 292 selects a bonus jackpot from the weighted pay table 294 and in stage 1156 pays 254 the gaming machine that receives the jackpot. This was fully discussed with respect to FIGS. 2 and 3 wherein the I/O board 370 activates indictor 320 and causes the conventional credit meter 390 in the gaming machine to credit the amount. In addition, the tower lamp 380 may or may not be activated. In the preferred embodiment, all of this occurs before the conventional game at that gaming machine is over. It is to be understood that the jackpot could be awarded 254 at anytime. Stage 1160 is now entered. In stage 1160, the value of the bonus jackpot awarded to that winning gaming machine G is subtracted from the jackpot pool.

Then stage 1164 is entered. In stage 1164, a determination 258 is made whether the current value (jackpot pool) 220 is less than or equal to zero. If it isn't, then the polling process repeats in stage 1112 for the next gaming machine. If the value of the jackpot pool is less than or equal to zero 258, then stage 1168 is entered and the bonus mode is sent to the inactive state (bonus mode end 260).

The current value 220 for the next game of the present invention is set in stage 1172 to the value of the jackpot pool, which as explained could be, and usually is negative. The following example based upon Games I and II above, is used to illustrate the operation of stage 1172. In Game I, the current value 220 incremented 244 until it exceeded the trigger value 218 of $200. When this occurred the current value equaled $202 so the excess of $2 was set aside for the next current value (for Game II) and the current value 220 (for Game I) became the jackpot pool. During the bonus mode time period of Game I, the controller 200 continued to collect contributions in stage 1112 and adds these contributions to the "excess" in the next current value 220 (for Game II). When Game I ends 258, the current value 220 (for Game I) is negative $5. In stage 1172, the controller adds the current value 220 at the end of Game I to the next current value 220 (for Game II) which at the end of Game I includes the value of the "excess" and the value of all contributions 1112 and 1116 added to it during the bonus mode time period for Game I. A base value, as used in the '909 patent could also be added to new pool (Game II) as an option.

It can be appreciated that the next current value 220 for the next game of the present invention is truly random and unpredictable.

The above disclosure sets forth a number of embodiments of the present invention. The present invention is not to be limited to a disclosure contained herein and other arrangements and embodiments, not precisely set forth, may be practiced under the teachings of the present invention and as set forth in the following claims.

I claim:

1. A method of operating a controller-based progressive jackpot linked gaming system, the gaming system having: a controller, a plurality of gaming machines connected to the controller, each gaming machine generating unit bet information indicative of a number of unit bets supplied to the gaming machine for playing a machine game on the aforesaid gaming machine; and said gaming system having a repeating controller game cycle; said method for each controller game cycle of the controller-based progressive jackpot linked gaming system comprising the steps, in the controller, of:

randomly selecting in the controller at the beginning of the controller game cycle a bonus mode activation value;

establishing in the controller at the beginning of the controller game cycle a current value;

adding in the controller incremental contributions based on unit bet information from the gaming machines to the current value;

entering a bonus mode time period in the controller after the current value is brought to or exceeding the bonus mode activation value as a result of unit bet information from a particular gaming machine;

randomly awarding a plurality of bonus jackpots from a payout table in the controller during the bonus mode time period to individual gaming machines;

subtracting in the controller awarded bonus jackpots from the current value;

ending the bonus mode time period in the controller when the current value is brought to or below zero.

2. The method of claim 1 with the step of including the next current value for the beginning of the next controller game cycle with the current value causing the immediately prior controller game cycle to end.

3. The method of claim 1 wherein the step of randomly selecting a bonus mode activation value further comprises the step of selecting the bonus mode activation value between a high limit and low limit.

4. The method of claim 1 further comprising the steps of:

entering a BONUS media display mode in response to the entering the bonus mode time period;

entering an AWARD media display mode in response to the awarding a bonus jackpot.

5. The method of claim 1 further comprising the step of determining eligible individual gaming machines to qualify for a bonus jackpot in response to entering the bonus mode time period wherein eligibility is determined by an individual gaming machine in a predetermined time period after a start of the machine game in the aforesaid individual gaming machine.

6. The method of claim 5 further comprising the step of activating an indicator at each gaming machine in the plurality of gaming machines corresponding to the eligibility status.

7. The method of claim 1 further comprising the step of activating an indicator at least at each eligible gaming machine in the plurality of gaming machines in during the bonus mode time period.

8. The method of claim 1 further comprising the step of activating an indicator at an individual gaming machine awarded a bonus jackpot.

9. The method of claim 1 wherein the step of randomly awarding a plurality of bonus jackpots further comprises the steps of:

a) starting a bonus jackpot round after entering into the bonus mode time period, (b) randomly establishing a bonus award trigger value between high and low limits, (c) setting a current counter to a set value, (d) incrementing the current counter by one for each unit bet information generated, (e) awarding a bonus jackpot to the gaming machine whose generated unit bet information caused the current counter to equal the bonus award value, (f) repeating steps (a) to (e) for the next bonus jackpot round.

10. The method of claim 1 wherein the step of awarding a plurality of bonus jackpots further comprises the step of randomly selecting the bonus jackpots from a weighted payout table in the controller.

11. A method of operating a controller-based progressive jackpot linked gaming system, the gaming system having: a controller, a plurality of gaming machines connected to the controller, each gaming machine generating unit bet information indicative of a number of unit bets supplied to the gaming machine for playing a machine game on the aforesaid gaming machine; and said gaming system having a repeating controller game cycle; said method for each controller game cycle of the controller-based progressive jackpot linked gaming system comprising the steps, in the controller, of:

randomly selecting at the beginning of the controller game cycle a bonus mode activation value;

establishing at the beginning of the controller game cycle a current value;

adding incremental contributions based on unit bet information from the gaming machines to the current value;

entering a bonus mode time period when the current value is brought to or exceeding the bonus mode activation value as a result of unit bet information from a particular gaming machine;

providing a display, said display containing pieces of a puzzle, each of said pieces of the puzzle carrying a portion of a picture;

turning over a piece of the puzzle to expose a portion of the picture in response to entering the bonus mode time period randomly awarding a plurality of bonus jackpots from a payout table during the bonus mode time period to individual gaming machines;

subtracting bonus jackpots from the current value;

ending the bonus mode time period when the current value is brought to or below zero.

12. A method for playing a controller-based bonus game in conjunction with gaming machines linked to a controller, each of the gaming machines playing a machine game after receiving a monetary amount having at least one unit bet, said method comprising the steps, in the controller, of:

randomly selecting in the controller a bonus mode trigger value between a high and a low limit;

providing a current value in the controller;

incrementing in the controller the current value as the gaming machines are played, the current value incremented by a fixed amount of each unit bet received by each gaming machine;

entering a bonus time period in the controller after the incremented current value is equal to or exceeds the bonus mode trigger value;

locking in all eligible gaming machines that are within a predetermined time frame after the machine game has started in response to entering the bonus time period as determined by the controller;

randomly awarding bonus jackpots from a pay table in the controller to the locked in gaming machines during the bonus time period;

decrementing in the controller the current value by the amount of each awarded bonus jackpot;

ending in the controller the bonus time period when the current value is less than or equal to a predetermined value.

13. The method of claim 12 wherein the step of providing a current value includes the prior current value from the prior bonus game.

14. The method of claim 12 wherein the fixed amount in the step of incrementing the current value is a percentage value of each unit bet.

15. The method of claim 12 further comprising the step of activating an eligibility indicator at a gaming machine that is being played and for a predetermined time frame after play has stopped.

16. The method of claim 12 wherein the step of randomly awarding bonus jackpots further comprises the steps of:

setting a high award limit, a low award limit and a current count value in response to entering the bonus time period;

for each bonus jackpot, performing the following steps:

(a) randomly selecting a bonus trigger award value between the high award limit and the low award limit;

(b) adding to the current count value the value of one for each unit bet received by each eligible gaming machine;

(c) identifying which eligible gaming machine provided the last unit bet added to the current count value when the current count value equals the bonus trigger award value;

(d) awarding a bonus jackpot to the identified eligible gaming machine;

(e) repeating steps (a) through (d) for each bonus award.

17. A method for playing a controller-based bonus game in conjunction with gaming machines linked to a controller, each of the gaming machines playing a machine game after receiving a monetary amount having at least one unit bet, said method comprising the steps, in the controller, of:

randomly selecting a bonus mode trigger value between a high and a low limit;

providing a current value;

incrementing the current value as the gaming machines are played, the current value incremented by a fixed amount of each unit bet received by each gaming machine;

entering a bonus time period when the incremented current value is equal to or exceeds the bonus mode trigger value;

locking in all eligible gaming machines that are within a predetermined time frame after the machine game has started in response to entering the bonus time period;

randomly awarding bonus jackpots to the locked in gaming machines during the bonus time period;

decrementing the current value by the amount of each awarded bonus jackpot;

ending the bonus time period when the current value is less than or equal to a predetermined value;

setting a high award limit, a low award limit and a current count value in response to entering the bonus time period; with the step of setting the high award limit and the low award limit so that each are proportional to the number of eligible gaming machines;

for each bonus jackpot, performing the following steps:

(a) randomly selecting a bonus trigger award value between the high award limit and the low award limit;

(b) adding to the current count value the value of one for each unit bet received by each eligible gaming machine;

(c) identifying which eligible gaming machine provided the last unit bet added to the current count value when the current count value equals the bonus trigger award value;

(d) awarding a bonus jackpot to the identified eligible gaming machine;

(e) repeating steps (a) through (d) for each bonus award.

18. A method for playing a controller-based bonus game in conjunction with gaming machines linked to a controller, each of the gaming machines playing a machine game after receiving a monetary amount having at least one unit bet, said method comprising the steps, in the controller, of:

randomly selecting a bonus mode trigger value between a high and a low limit;

providing a current value;

incrementing the current value as the gaming machines are played, the current value incremented by a fixed amount of each unit bet received by each gaming machine;

entering a bonus time period when the incremented current value is equal to or exceeds the bonus mode trigger value;

locking in all eligible gaming machines that are within a predetermined time frame after the machine game has started in response to entering the bonus time period;

randomly awarding bonus jackpots to the locked in gaming machines during the bonus time period;

decrementing the current value by the amount of each awarded bonus jackpot;

ending the bonus time period when the current value is less than or equal to a predetermined value;

setting a high award limit, a low award limit and a current count value in response to entering the bonus time period; with the step of setting the high award limit and the low award limit so that each are proportional to the maximum unit bet for the gaming machines;

for each bonus jackpot, performing the following steps:

(a) randomly selecting a bonus trigger award value between the high award limit and the low award limit;

(b) adding to the current count value the value of one for each unit bet received by each eligible gaming machine;

(c) identifying which eligible gaming machine provided the last unit bet added to the current count value when the current count value equals the bonus trigger award value;

(d) awarding a bonus jackpot to the identified eligible gaming machine;

(e) repeating steps (a) through (d) for each bonus award.

19. A method for playing a controller-based bonus game in conjunction with gaming machines linked to a controller, each of the gaming machines playing a machine game after receiving a monetary amount having at least one unit bet, said method comprising the steps, in the controller, of:

randomly selecting a bonus mode trigger value between a high and a low limit;

providing a current value;

incrementing the current value in the controller as the gaming machines are played, the current value incremented by a fixed amount of each unit bet received by each gaming machine;

entering a bonus time period when the incremented current value is equal to or exceeds the bonus mode trigger value;

locking in all eligible gaming machines that are within a predetermined time frame after the machine game has started in response to entering the bonus time period;

randomly awarding bonus jackpots to the locked in gaming machines during the bonus time period;

decrementing the current value by the amount of each awarded bonus jackpot;

ending the bonus time period when the current value is less than or equal to a predetermined value;

setting a high award limit, a low award limit and a current count value in response to entering the bonus time period; with the steps of setting the high award limit to (J) times (the number of eligible machines) times (the maximum unit bet for gaming machines) and the low award limit to (K) times (the number of eligible machines) times (the maximum unit bet) so J is greater in value than K;

for each bonus jackpot, performing the following steps:

(a) randomly selecting a bonus trigger award value between the high award limit and the low award limit;

(b) adding to the current count value the value of one for each unit bet received by each eligible gaming machine;

(c) identifying which eligible gaming machine provided the last unit bet added to the current count value when the current count value equals the bonus trigger award value;

(d) awarding a bonus jackpot to the identified eligible gaming machine;

(e) repeating steps (a) through (d) for each bonus award.

20. A method for playing a controller-based bonus game in conjunction with gaming machines linked to a controller, each of the gaming machines playing a machine game after receiving a monetary amount, said method comprising the steps, in the controller, of:

randomly entering in the controller a bonus time period;

determining eligible gaming machines in the controller in response to entering the bonus time period based on gaming machines still within a predetermined time frame after machine game play starts;

awarding random bonus jackpots from a pay table in the controller to random individual eligible gaming machines at random times during the bonus time period.

21. The method of claim 20 further comprising the step of indicating to the area containing the gaming machines when the bonus time period is entered.

22. The method of claim 20 further comprising the step of indicating to the area containing the gaming machines during the entire bonus mode period.

23. The method of claim 20 further comprising the step of indicating at each eligible gaming machine that the bonus mode time period is entered.

24. The method of claim 20 further comprising the step of indicating at a gaming machine when a gaming machine is eligible before entering the bonus time period.

25. The method of claim 20 further comprising the step of indicating at a gaming machine when a gaming machine receives a bonus jackpot during the bonus time period.

26. The method of claim 20 further comprising the step of delivering the value of a bonus jackpot to a credit meter in the gaming machine receiving the awarded bonus jackpot.

27. The method of claim 20 wherein the monetary amount comprises a number of unit bets and wherein the step of randomly entering a bonus time period comprises the steps of:

randomly selecting a bonus mode trigger value between a high and a low limits;

providing a current value;

incrementing the current value when the gaming machines are played, the current value incremented by a fixed amount of each unit bet received by each gaming machine;

entering the bonus time period when the incremented current value is equal to or exceeds the bonus mode trigger value.

28. The method of claim 27 further comprising the steps of:

decrementing the current value by the amount of each awarded jackpot bonus;

ending the bonus time period when the current value is less than or equal to zero.

29. The method of claim 20 wherein the step of randomly entering a bonus period is based upon the monetary amounts received by the gaming machines.

30. The method of claim 20 wherein the monetary amount received by a gaming machine comprises a number of unit bets and wherein the step of randomly awarding bonus jackpots counts the units bets to randomly select the individual gaming machine at the random time.

31. The method of claim 20 wherein the step of awarding random bonus awards further comprises the step of selecting a bonus jackpot randomly from a weighted a payout table.

32. A method for awarding a plurality of bonus jackpots while playing machine games on gaming machines, the gaming machines linked to a controller, each gaming machine played after a monetary value is received, said method comprising the steps, in the controller, of:

establishing eligibility in the controller when a gaming machine is within a predetermined time interval after the machine game starts;

entering a bonus mode time period in the controller for only those eligible gaming machines;

awarding the plurality of bonus jackpots during the bonus mode time period to the eligible gaming machines from a weighted payout schedule in the controller.

33. A method for awarding bonus jackpots while playing machine games on gaming machines, the gaming machines linked to a controller, each gaming machine played after a monetary value is received, said method comprising the steps, in the controller, of:

establishing eligibility when a gaming machine is within a predetermined time interval after the machine game starts;

entering a bonus mode time period for only those eligible gaming machines;

awarding the bonus jackpots during the bonus mode time period to the eligible gaming machines from a weighted payout schedule in the controller;

displaying a puzzle having a plurality of different pieces in the area of the gaming machines;

uncovering one piece of the puzzle upon entering each of said plurality or bonus mode time period.

34. A method for playing a controller-based game in conjunction with gaming machines linked to a controller, each of the gaming machines playing a machine game after receiving a monetary amount, said method, in the controller, comprising the steps of:

determining a current value in the controller based upon the prior bonus jackpot value causing the prior controller-based game to end;

selecting in the controller a bonus mode trigger value;

incrementing the current value in the controller as the gaming machines receive the monetary amounts;

entering a bonus time period in the controller after the incremented current value is equal to or exceeds the bonus mode trigger value;

setting in the controller a bonus jackpot equal to the bonus mode trigger value in response to entering the bonus time period;

determining in the controller the eligibility of the gaming machines in response to the step of entering the bonus time period;

randomly selecting eligible gaming machines in the controller during the bonus time period;

randomly awarding a bonus jackpot amount from a pay table in the controller to each selected eligible gaming machine;

decrementing in the controller the bonus jackpot by the amount of each awarded bonus jackpot amount;

ending the bonus time period in the controller when the bonus jackpot is less than or equal to a predetermined amount.

35. The method of claim 34 in which the step of determining a current value comprises the step of adding to the prior jackpot value the excess of the prior bonus current value over the prior bonus mode trigger value when the prior bonus mode time period was entered.

36. The method of claim 35 in which the step of determining a current value further comprises the step of adding to the prior bonus jackpot value the increments from the gaming machines during the prior bonus time period.

37. The method of claim 34 in which the step of selecting a bonus mode trigger value further comprises the step of randomly selecting the bonus mode trigger value between a high limit and low limit.

38. The method of claim 34 in which the step of incrementing the current value further comprises the step of incrementing the current value by a predetermined percentage value of the received monetary amounts.

39. The method of claim 34 in which the step of determining the eligibility further comprises the steps of:

prior to entering into the bonus time period, providing a predetermined time period after each gaming machine has started playing its machine game;

locking in all gaming machines still in their predetermined time periods when the bonus time period is entered.

40. The method of claim 34 further comprising the step of activating an indicator at each gaming machine provided with a predetermined time period so as to inform the player at each said gaming machine that the gaming machine is eligible to participate in the bonus time period so long as the next machine game at the said gaming machine is started before the predetermined time period for the prior machine game ends.

41. The method of claim 40 with the step of maintaining activated the indicator for each locked in gaming machine for the duration of the bonus time period.

42. The method of claim 34 wherein the monetary amount comprises a number of unit bets and wherein the step of randomly selecting eligible gaming machines comprises the steps of:

(a) starting a bonus jackpot round in response to entering the bonus time period;

(b) randomly establishing a bonus award trigger between high and low limits;

(c) setting a current counter to a set value;

(d) incrementing the current counter with each unit bet from each eligible gaming machine during the bonus time period;

(e) selecting the gaming machine whose unit bet caused the current counter to equal the bonus award trigger.

43. The method of claim 34 wherein the step of randomly awarding a bonus jackpot comprises the step of randomly selecting a bonus jackpot from a weighted payout table in the controller.

44. A method for playing a controller-based game in conjunction with gaming machines linked to a controller, each of the gaming machines playing a machine game after receiving a monetary amount, said method, in the controller, comprising the steps of:

determining a current value in the controller based upon the prior bonus jackpot value causing the prior controller-based game to end;

randomly selecting in the controller a bonus mode trigger value between a high limit and low limit;

incrementing in the controller the current value as the gaming machines receive the monetary amounts;

entering in the controller a bonus time period after the incremented current value is equal to or exceeds the bonus mode trigger value;

setting in the controller a bonus jackpot equal to the bonus mode trigger value in response to entering the bonus time period;

providing in the controller a predetermined time period after each gaming machine has started playing its machine game;

locking in as eligible all gaming machines still in their predetermined time periods when the bonus time period is entered as determined by the controller;

randomly selecting in the controller eligible gaming machines during the bonus time period, wherein the monetary amount comprises a number of unit bets and wherein the step of randomly selecting eligible gaming machines comprises the sub-steps of:

(a) starting a bonus jackpot round in response to entering the bonus time period;

(b) randomly establishing a bonus award trigger between high and low limits;

(c) setting a current counter to a set value;

(d) incrementing the current counter with each unit bet from each eligible gaming machine during the bonus time period;

(e) selecting the gaming machine whose unit bet caused the current counter to equal the bonus award trigger;

randomly awarding a bonus jackpot amount from a weighted payout table in the controller to each randomly selected eligible gaming machine;

decrementing in the controller the bonus jackpot by the amount of each awarded bonus jackpot amount;

ending the bonus time period in the controller when the bonus jackpot is less than or equal to a predetermined amount.

45. The method of claim 44 in which the step of determining a current value comprises the step of adding to the prior bonus jackpot value the excess of the prior current value over the prior bonus mode trigger value when the prior bonus mode time period was entered.

46. The method of claim 45 in which the step of determining a current value further comprises the step of adding to the prior bonus jackpot value the increments from the gaming machines during the prior bonus time period.

* * * * *